US011248804B2

(12) United States Patent
Liu et al.

(10) Patent No.: US 11,248,804 B2
(45) Date of Patent: Feb. 15, 2022

(54) STOVE

(71) Applicants: Qiuna Liu, Qingdao (CN); Bo Shi, Qingdao (CN)

(72) Inventors: Qiuna Liu, Qingdao (CN); Bo Shi, Qingdao (CN)

( * ) Notice: Subject to any disclaimer, the term of this patent is extended or adjusted under 35 U.S.C. 154(b) by 175 days.

(21) Appl. No.: 16/572,903

(22) Filed: Sep. 17, 2019

(65) Prior Publication Data

US 2020/0333017 A1 Oct. 22, 2020

(30) Foreign Application Priority Data

Apr. 17, 2019 (CN) ..... 201920522185.0

(51) Int. Cl.
*F24C 15/02* (2006.01)
*F24C 15/00* (2006.01)

(52) U.S. Cl.
CPC ..... *F24C 15/001* (2013.01); *F24C 15/02* (2013.01)

(58) Field of Classification Search
CPC ..... F24C 15/001; F24C 15/02; F23B 60/00; F24B 5/023; F24B 1/26; F24B 1/22; F23N 3/007
See application file for complete search history.

(56) References Cited

U.S. PATENT DOCUMENTS 34,433 A 2/1862 Lambert
396,846 A * 1/1889 Ancel ..... E04H 15/24 135/92
440,964 A * 11/1890 Reed ..... F23J 1/00 237/47
4,844,108 A * 7/1989 Rohrer ..... E04H 15/24 135/91
5,195,423 A * 3/1993 Beller ..... A47J 37/0786 99/340
5,203,316 A * 4/1993 Pritchett ..... E04H 15/14 126/15 R (Continued)

FOREIGN PATENT DOCUMENTS

CA 2741855 A1 11/2012
FR 614641 A 12/1926

(Continued)

OTHER PUBLICATIONS

European Search Report EP 19 20 1542, dated Apr. 24, 2020.

*Primary Examiner* — Alfred Basichas
(74) *Attorney, Agent, or Firm* — Bond Schoeneck & King, PLLC; George McGuire

(57) ABSTRACT

The present disclosure belongs to the technical field of the combustion heating stove, and disclosed is a stove including a stove body, an air inlet channel and an exhaust channel. When the stove body is used in an enclosed space, an air inlet end of the air inlet channel is in communication with an outside of the enclosed space, a connection end of the air inlet channel is in communication with an air inlet of the stove body, the air inlet channel is operative to introduce air into the stove body from the outside of the enclosed space; and a connection end of an exhaust channel is in communication with an exhaust port of the stove body, an exhaust end of the exhaust channel is in communication with the outside of the enclosed space, whereby the exhaust channel is operative to discharge exhaust gas in the stove body out of the enclosed space.

17 Claims, 24 Drawing Sheets

(56) References Cited

U.S. PATENT DOCUMENTS

| | | | | |
|---|---|---|---|---|
| 6,397,833 | B1 * | 6/2002 | Jarvi | F23B 1/38 110/214 |
| 10,610,051 | B2 * | 4/2020 | Hussain | A47J 37/0763 |
| 2019/0191928 | A1 * | 6/2019 | Hussain | A47J 37/0763 |

FOREIGN PATENT DOCUMENTS

| | | | |
|---|---|---|---|
| JP | 3222444 | U | 8/2019 |
| KR | 20120005098 | U | 11/2006 |
| WO | 2006121326 | A1 | 11/2006 |

* cited by examiner

STOVE

CROSS-REFERENCE TO RELATED APPLICATIONS

This application claims the priority of China patent application No. 201920522185.0 filed on Apr. 17, 2019, disclosure of which is hereby incorporated herein by reference in its entirety.

TECHNICAL FIELD

The present disclosure relates to the technical field of combustion heating stoves, and more particularly relates to a stove.

BACKGROUND

As a type of widely used cookware, stoves are being increasingly used by users in outdoor activities such as camping and explorations. In outdoor activities such as camping and explorations, users need to stay in an enclosed space such as a tent, so the stove is required to be able to provide safety in addition to portability. When an existing stove is used in an enclosed space such as a tent in the wilderness or the like, the stove would consume the oxygen in the tent, and toxic gas produced in the combustion process of the fuel is easily leaked in the tent, posing a great danger to the users.

SUMMARY

It is an object of the present disclosure to provide a stove that allows a user to safely use the stove in an enclosed space.

To achieve this object, the present disclosure adopts the following solutions.

There is provided a stove that includes a stove body, an air inlet channel, and an exhaust channel.

When the stove body is used in an enclosed space, an air inlet end of the air inlet channel is in communication with an outside of the enclosed space, and a connection end of the air inlet channel is in communication with an air inlet of the stove body. The air inlet channel is operative to introduce air into the stove body from the outside of the enclosed space. A connection end of the exhaust channel is in communication with an exhaust port of the stove body, and an exhaust end of the exhaust channel is in communication with the outside of the enclosed space, whereby the exhaust channel is operative to discharge an exhaust gas in the stove body out of the enclosed space.

In some embodiments, the stove is provided with an air intake adjusting device configured to adjust an opening degree of the air inlet, and is further provided with a stove door arranged on a front side of the stove body. The openability of the stove door is associated with an opening degree of air inlet, and only when the opening degree of the air inlet is 0% or the air inlet is totally closed is the stove door openable by a user.

In some embodiments, the air intake adjusting device comprises: a baffle rotatably arranged inside the connection end of the air inlet channel through a rotating shaft; an adjusting rod extending from a front side of the stove body to a rear side of the stove body and rotatably connected to the stove body; and a transmission assembly, where one end of the adjusting rod is connected to an operating bar, and another end of the adjusting rod is connected to the rotating shaft via the transmission assembly. The transmission assembly is operative to convert a rotary motion of the operating bar performed by a user into a rotary motion of the baffle, and the stove door is not confined by the operating bar only when the air inlet is completely blocked by the baffle thereby preventing external air outside of the enclosed space from entering the stove body.

In some embodiments, the transmission assembly comprises: a first gear fixedly connected to one end of the rotating shaft; and a second gear fixedly connected to the other end of the adjusting rod. The first gear and the second gear are engaged with each other and are operative to transfer a rotary motion of the first gear in a plane of the first gear into a rotary motion of the second gear in a plane of the second gear.

In some embodiments, a plane of the first gear is perpendicular to the rotating shaft, a plane of the second gear is perpendicular to the adjusting rod, the plane of the first gear is perpendicular to the plane of the second gear, and the rotating shaft is perpendicular to the adjusting rod. When a plane of the baffle is perpendicular to a longitudinal axis of the air inlet, the operating bar is perpendicular to a width of the stove door, and the stove door is not confined by the operating bar only when the operating bar is at the position perpendicular to the width of the stove door.

In some embodiments, the operating bar is confined to move back and forth between a position parallel to the width of the stove door and a position perpendicular to the width of the stove door. The position of the operating bar parallel to the width of the stove door corresponds to a position of the baffle parallel to the longitudinal axis of the air inlet, and the position of the operating bar perpendicular to the width of the stove door corresponds to a position of the baffle perpendicular to the longitudinal axis of the air inlet. In some embodiments, there are provided one or more air supplement zones in the stove body, where the air supplement zones are in communication with the connection end of the air inlet channel.

When the stove body is used, air entering the stove body via the air inlet may pass through the air supplement zones to be discharged out from the exhaust port.

In some embodiments, there are provided two air supplement zones, including a first air supplement zone and a second air supplement zone. The air entering the stove body via the air inlet successively passes through the first air supplement zone and the second air supplement zone and then is discharged out from the exhaust port.

In some embodiments, a stove door is arranged on a front side of the stove body. The air inlet is disposed on a rear side of the stove body. An air guide plate is arranged in the stove body to separate an interior of the stove body into an upper part and a lower part. The first air supplement zone is located on a front side of the lower part of the air guide plate, and the second air supplement zone is located on a rear side of the upper part of the air guide plate.

In some embodiments, the first air supplement zone is in communication with the connection end of the air inlet channel via a first air supplement channel.

The first air channel includes an ash box and a first air supplement pipe that are in communication with each other. The ash box is disposed in a bottom of the stove body and is in communication with the first air supplement zone via an opening in the bottom of the stove body. One end of the first air supplement pipe is in communication with the connection end of the air inlet channel, and another end of the first air supplement pipe is in communication with a side of the ash box. There is provided an ash tray at a bottom of the ash box, and the ash tray is operative to open or close an opening in the bottom of the ash box.

In some embodiments, the second air supplement zone is in communication with the connection end of the air inlet channel via a second air supplement channel.

The second air supplement channel includes a plurality of second air supplement pipes. An end of each of the plurality of second air supplement pipes is in communication with the connection end of the air inlet channel, and another end of the second air supplement pipe extends into the stove, and an air venting hole is opened in a sidewall of the portion of each of the plurality of second air supplement pipes that extends into the stove body.

In some embodiments, the stove body is provided with an air intake adjusting device, which can adjust the opening degree of the air inlet.

In some embodiments, the air intake adjusting device further includes:

a baffle, rotatably arranged inside the connection end of the air inlet channel via a rotating shaft; and an adjusting rod, extending from a front side of the stove body to a rear side of the stove body and slidably connected to the stove body. An end of the adjusting rod is connected to an operating handle, and another end of the adjusting rod is connected to the rotating shaft via a transmission assembly, where the adjusting rod when sliding is operative to drive the baffle to rotate to adjust the opening degree of the air inlet.

In some embodiments, the first air supplement zone is in communication with the connection end of the air inlet channel via a first air supplement channel.

An air supplement adjusting device is arranged in the stove body and is operative to adjust an opening degree of a communicating port between the first air supplement channel and the stove body.

In some embodiments, two casings are further included, separately and rotatably connected to the stove body, and symmetrically arranged at the top of the stove body.

The two casings when fitted together are operative to enclose a closed baking space on the top of the stove body.

In some embodiments, a horizontal elongated hole is defined in a front side of the stove body, and the stove further includes a stove cover operative to be inserted into the stove body via the elongated hole to fully seal up a fire vent in a top surface of the stove body as well as the elongated hole. The stove cover is further detachable from the stove body by being pulled off via the elongated hole defined in the front side of the stove body.

The present disclosure provides the following beneficial effects.

On the basis of the stove body, the air inlet channel works in coordination with the exhaust channel, so that when the stove is used in an enclosed space such as a tent, air can be introduced from the outside and smoke produced from combustion can be discharged to the outside. Thus, oxygen in the enclosed space is not consumed, so the problem that the smoke and the like are leaked in the enclosed space is solved, enabling the user to safely use the stove in the enclosed space.

On the basis of the air inlet, two air supplement zones are arranged in the stove body, so that during the whole combustion process of the fuel in the stove body, three times of ventilation are performed to support the combustion, thereby effectively avoiding the problem of the production of harmful gas due to insufficient combustion of the fuel.

Figure 1:
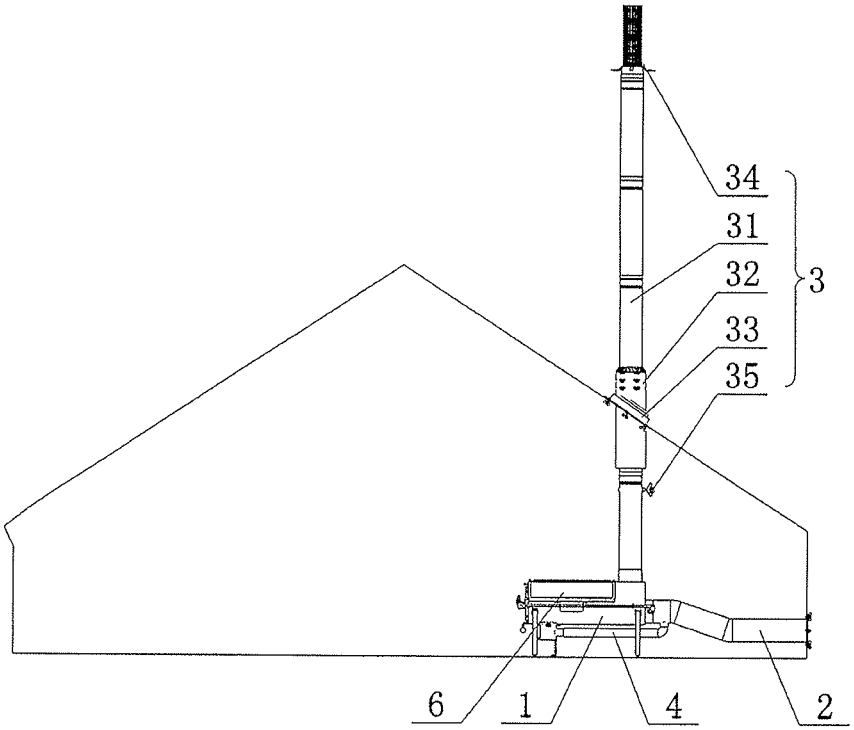
FIG. 1 is a schematic diagram illustrating a stove in an enclosed space according to an embodiment of the present disclosure.

1. Stove body; 11. Air guide plate; 12. Air intake adjusting device; 121. Baffle; 122. Adjusting rod; 123. Operating bar; 124. First gear; 125. Second gear; 13. Air supplement adjusting device; 131. Adjusting plate; 132. Pull rod; 14. Stove cover; 15. Baking net; 16. Leg; 17. Fuel grate; 18. Stove door; 181. Door handle; 1811. Latch piece; 1812. Grip;

2. Air inlet channel;

3. Exhaust channel; 31. Tubular body; 311. Tubular segment; 32. Chimney protector; 33. Silicone protector; 34. Flame arrestor; 35. Flow regulator;

4. First air supplement channel; 41. Ash box; 411. Ash tray; 42. First air supplement pipe;

5. Second air supplement channel; 51. Second air supplement pipe; 511. Air venting hole;

6. Casing; 61. Handle.

DETAILED DESCRIPTION

Embodiments in accordance with the present disclosure will now be described in detail below. Examples of the embodiments are illustrated in the drawings, where the same or similar reference numerals indicate the same or similar elements or elements having the same or similar functions. The embodiments described below with reference to the drawings are exemplary, intended to explain the present disclosure, and not to be construed as limiting the present disclosure.

In the description of embodiments of the present utility mode, unless otherwise expressly specified and defined, terms "connected to each other", "connected to" or "fixed to" are to be construed in a broad sense, for example, as fixedly connected, detachably connected, mechanically connected or electrically connected, directly connected to each other or indirectly connected to each other via an intermediary, or internally connected or interactional between two components. For those of ordinary skill in the art, specific meanings of the above terms in the present disclosure can be understood depending on specific contexts.

In the description of the present disclosure, unless otherwise expressly specified and defined, when a first feature is described as "on" or "below" a second feature, the first feature and the second feature may be in direct contact, or be in contact via another feature between the two features instead of being in direct contact. Furthermore, when the first feature is described as "on", "above" or "over" the second feature, the first feature is right on or obliquely on the second feature, or the first feature is simply at a horizontally higher level than the second feature. When the first feature is described as "under", "below" or "underneath" the second feature, the first feature is right under, below or underneath the second feature or the first feature is obliquely under, below or underneath the second feature, or the first feature is simply at a lower level than the second feature.

Solutions of the present disclosure are further described below through embodiments in conjunction with the drawings.

As shown in FIGS. 1 to 14, the present disclosure provides a stove, including a stove body 1, an air inlet channel 2, and an exhaust channel 3. When the stove body 1 is used in an enclosed space, an air inlet end of the air inlet channel 2 is in communication with an outside of the enclosed space, and a connection end of the air inlet channel 2 is in communication with an air inlet of the stove body 1, so that the air inlet channel 2 is operative to introduce air into the stove body 1 from the outside of the enclosed space. A connection end of the exhaust channel 3 is in communication with an exhaust port of the stove body 1, an exhaust end of the exhaust channel 3 is in communication with the outside of the enclosed space, so that the exhaust channel 3 is operative to discharge an exhaust gas in the stove body 1 out of the enclosed space.

In the present disclosure, on the basis of the stove body 1, the air inlet channel 2 works in coordination with the exhaust channel 3, so that when the stove is used in the enclosed space such as a tent, air can be introduced from the outside and smoke produced from combustion is exhausted to the outside, and oxygen in the enclosed space is not consumed, the problem that the smoke and the like are leaked in the enclosed space is solved, and a user can safely use the stove in the enclosed space.

Optionally, one or more air supplement zones may be arranged inside the stove body 1, and are in communication with the connection end of the air inlet channel 2. When the stove body 1 is used, air entering the stove body 1 from the air inlet may pass through the air supplement zone and then is discharged out from the exhaust port. By employing the above arrangement, most of air entering the stove body 1 through the air inlet of the stove body 1 not only supports combustion, but can be supplemented once or a plurality of times in the stove body 1, so that fuel in the stove body 1 can be combusted more thoroughly.

Specifically, in the present embodiment, there are provided two air supplement zones, including a first air supplement zone and a second air supplement zone. The air entering the stove body via the air inlet successively passes through the first air supplement zone and the second air supplement zone and then is discharged out from the exhaust port. By the above arrangement, after entering the inside of the stove body 1 via the air inlet of the stove body 1 and supporting the combustion, most of the air would supplement air in the first air supplement zone and then supplement air in the second air supplement zone along the circulation path of the air inside the stove body 1. Therefore, by providing the air supplements twice, the fuel can be burnt more thoroughly, avoiding the production of toxic gases such as carbon monoxide and the like in cases of insufficient fuel combustion.

Figure 2:
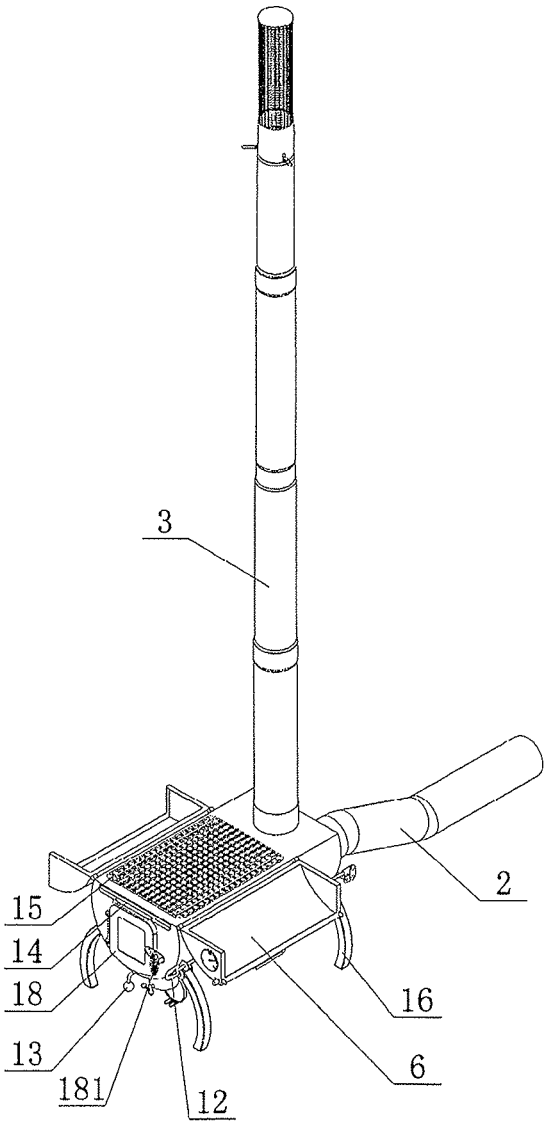
FIG. 2 is a schematic diagram illustrating a stove according to an embodiment of the present disclosure.
Figure 3:
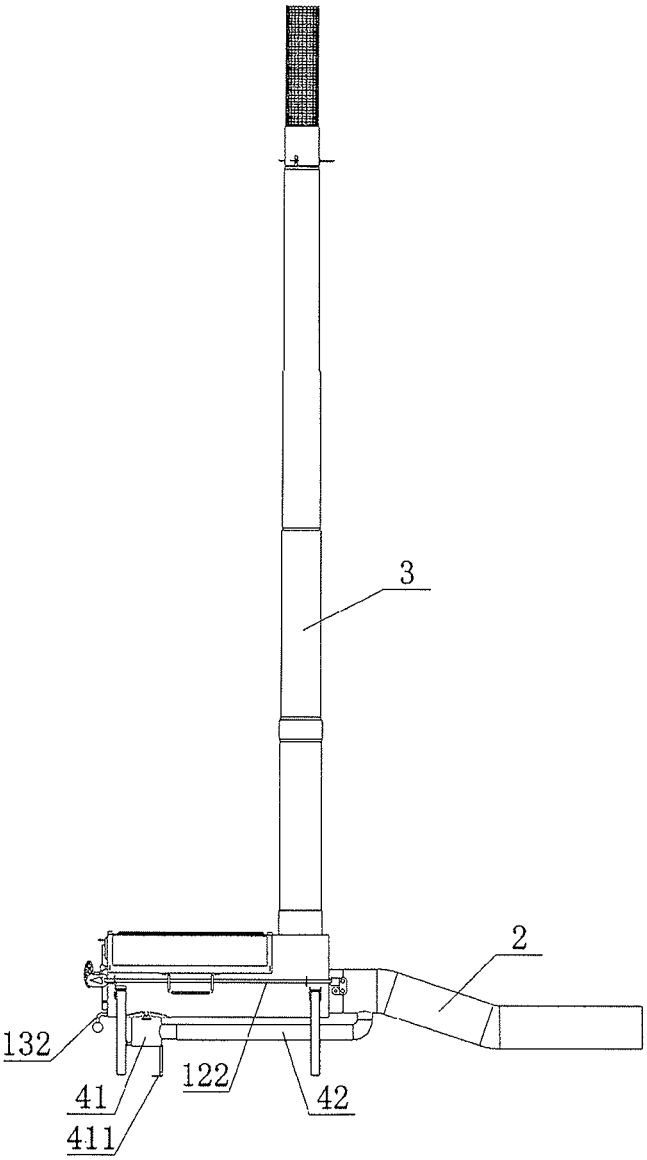
FIG. 3 is a right side view of a stove according to an embodiment of the present disclosure.
Figure 4:
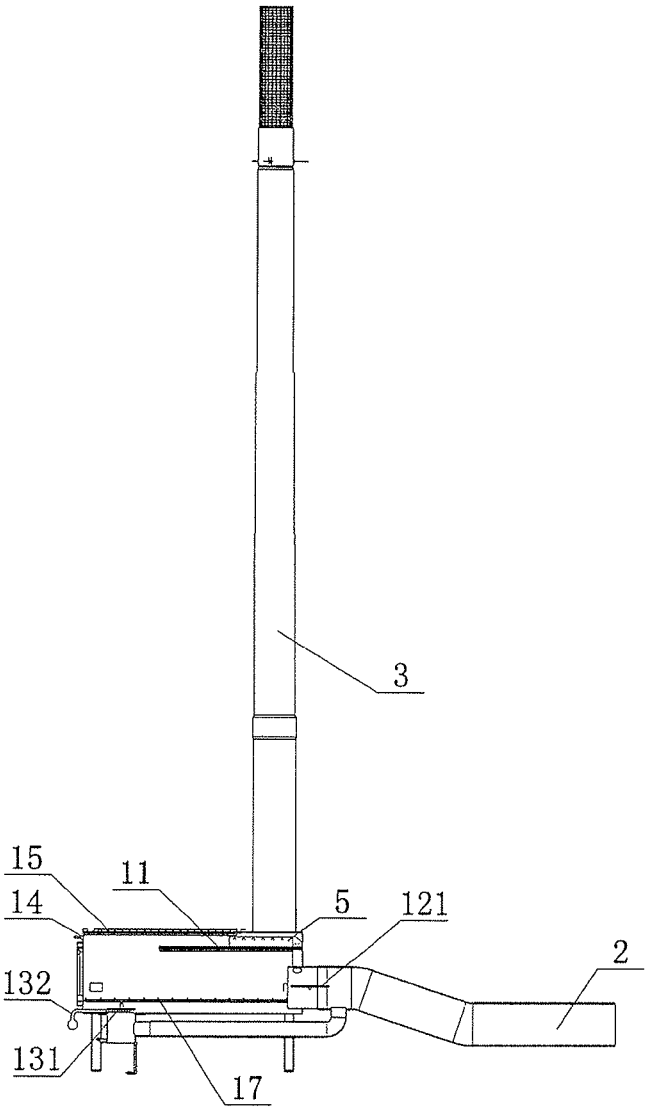
FIG. 4 is a partial sectional view of a stove according to an embodiment of the present disclosure.

More specifically, as shown in FIGS. 2, 3, and 4, a stove door 18 is arranged at a front side of the stove body 1, the air inlet is arranged at a rear side of the stove body 1, and the exhaust port is provided at the top of the stove body 1 near the air inlet. An air guide plate 11 is provided inside the stove body 1, and is disposed between the air inlet and the exhaust port. The air inlet and the first air supplement zone are disposed on a side of the air guide plate 11, the exhaust port and the second air supplement zone are disposed on another side of the air guide plate 11, the first air supplement zone is disposed on a front lower side of the air guide plate 11, and the second air supplement zone is disposed on a rear upper side of the air guide plate 11. Besides a gas-guiding function, the gas guide plate 11 also has a function of blocking smoke, so that the smoke is prevented from flowing back from the exhaust channel 3.

By employing the above arrangement, the space inside the stove body 1 is separated into an upper part and a lower part, where the upper part is smaller than the lower part, and the two parts are in communication with each other at the front side of the stove body 1, so that air entering from an air inlet at the lower half part of the rear side of the stove body 1 cooperates with fuel at the rear side in the stove body 1 for combustion, where the combustion is incomplete at this moment, and therefore a large amount of carbon monoxide and black smoke are generated. Then the air horizontally flows to the front side of the stove body 1 for the first air supplement, where a second combustion is performed, so that carbon monoxide and the like produced from the first combustion are further consumed. The air is supplemented in the first air supplement zone and then flows upwards to the upper half part of the stove body 1 and then flows from the front side to the rear side of the stove body 1, the air is supplemented for the second time at the upper half part of the rear side of the stove body 1, so that the carbon monoxide and the like are consumed once more, and after being supplemented in the second air supplement zone, the air enters the exhaust channel 3 from the exhaust port at the top of the rear side of the stove body 1, here the air undergoes one reciprocating circulation from back to front in the stove body 1. Therefore, as described above, by virtue of the three combustions that happen at different positions of the combustion chamber of the stove body 1, there would substantially be no visible smoke coming out of the exhaust channel 3.

Optionally, as shown in FIGS. 2 and 3, the stove body 1 is provided with an air intake adjusting device 12, which is operative to adjust an opening degree of the air inlet. By employing the above arrangement, the users are able to control a flow rate of intake air into the air inlet channel 2 by controlling the air intake adjusting device 12.

Figure 5:
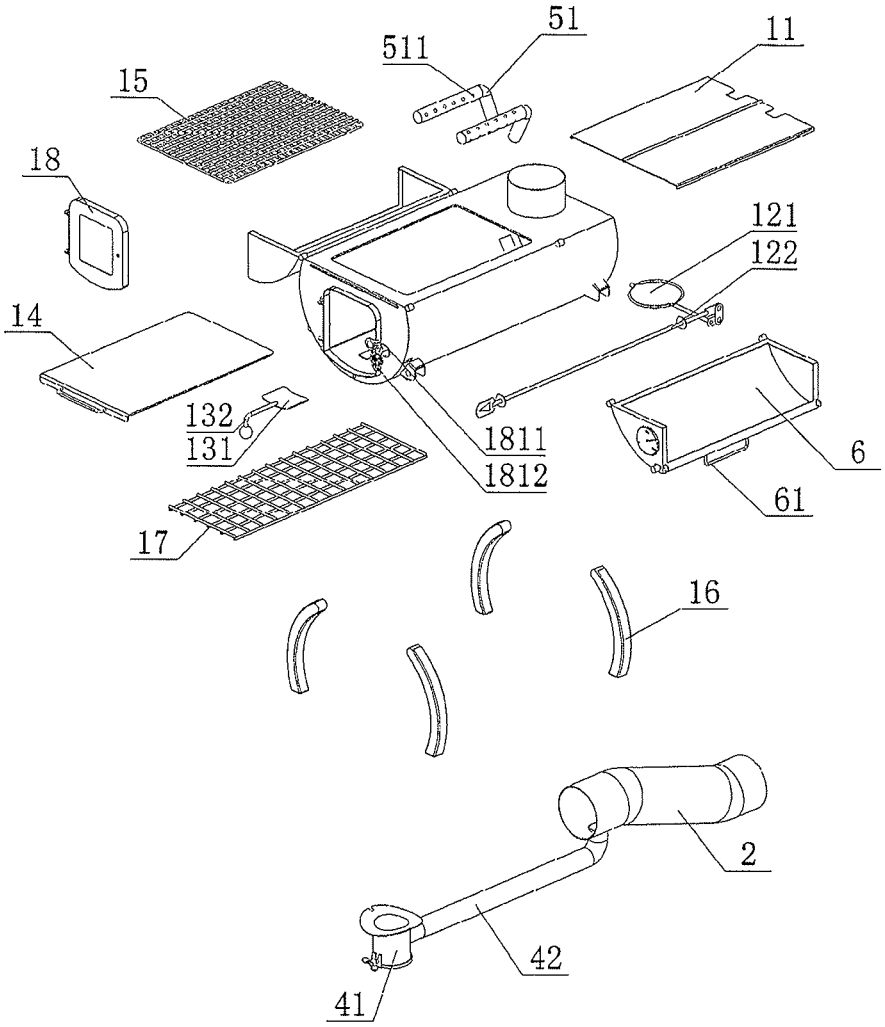
FIG. 5 is an exploded view of a partial structure of a stove observed from a perspective according to an embodiment of the present disclosure.
Figure 6:
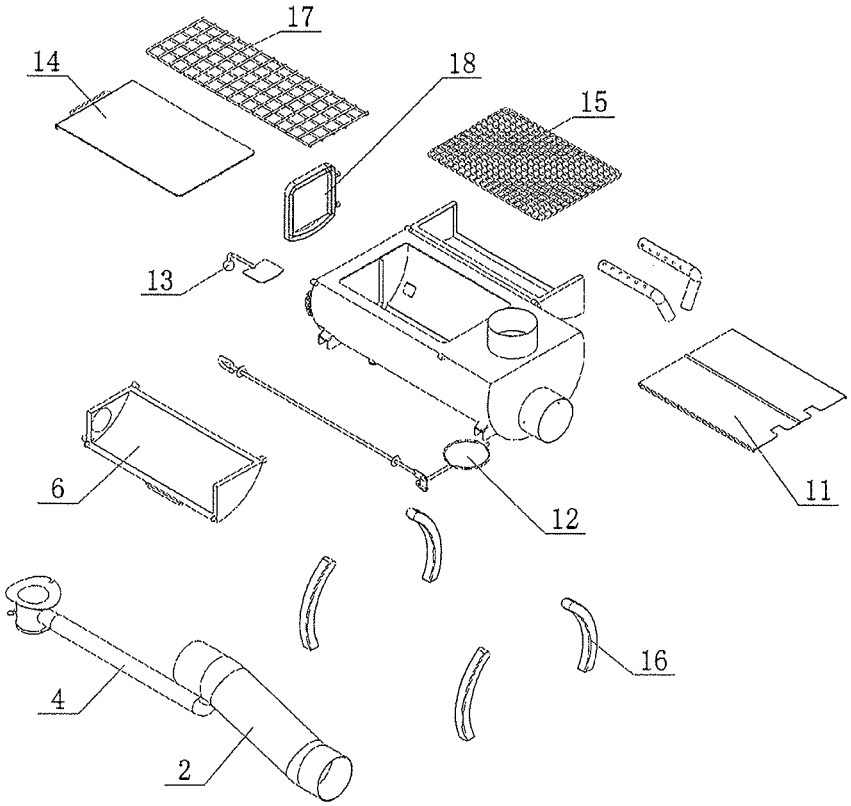
FIG. 6 is an exploded view of a partial structure of a stove observed from another perspective according to an embodiment of the present disclosure.

Specifically, as shown in FIGS. 5 and 6, the air intake adjusting device 12 includes a baffle 121 and an adjusting rod 122. The baffle 121 is rotatably arranged inside the connection end of the air inlet channel 2 via a rotating shaft, and an adjusting rod 122 extends from the front side of the stove body 1 to the rear side of the stove body 1 and is slidably connected to the stove body 1. An end of the adjusting rod 122 is connected to an operating handle and another end of the adjusting rod 122 is connected to the rotating shaft via a transmission assembly. The adjusting rod 121 when sliding is operative to drive the baffle 121 to rotate to adjust the opening degree of the air inlet.

More specifically, the transmission assembly includes two transmission pieces, an end of one of the transmission pieces is rotatably connected to the adjusting rod 122, another end is rotatably connected to an end of the other transmission piece, and another end of the other transmission piece is rotatably connected to the rotating shaft. The user may hold the operating handle and pull the adjusting rod 122 standing at the front side of the stove body 1, so that the adjusting rod 122 would slide along a front and back orientation of the stove body 1, and then the rotating shaft is driven to rotate by the two transmission pieces, and an included angle between the baffle 121 and an axis of the air inlet channel 2 is driven to be changed when the rotating shaft rotates, so that the opening degree of the air inlet is adjusted. When the included angle between the baffle 121 and the axis of the air inlet channel 2 is 90 degrees, the air inlet is completely closed, and when the included angle between the baffle 121 and the axis of the air inlet channel 2 is 0 degrees, the air inlet is completely opened.

Figure 12:
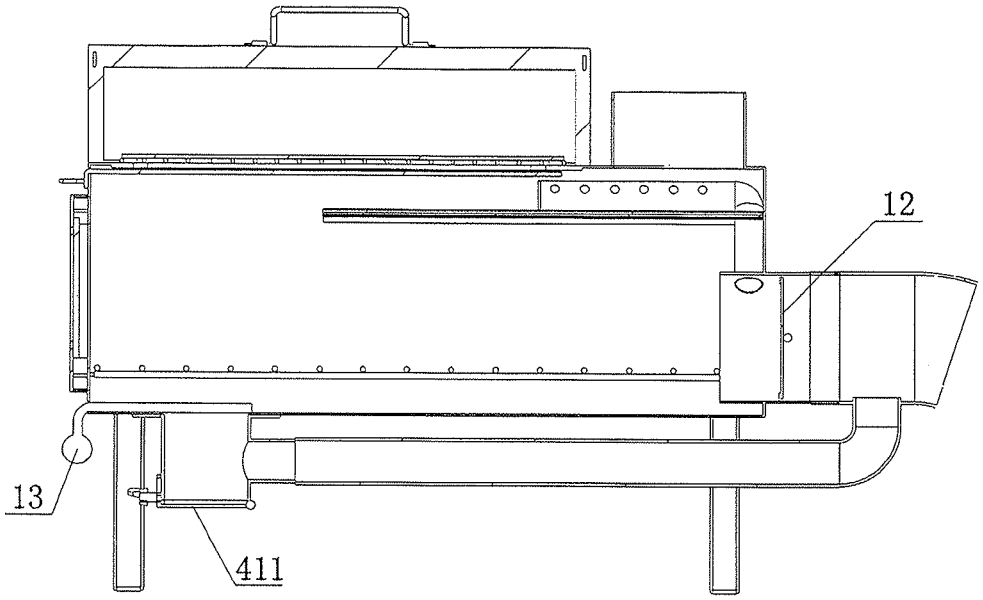
FIG. 12 is a sectional view of an air intake adjusting device, an air supplement adjusting device, and an ash tray that are completely closed in a stove according to an embodiment of the present disclosure.

More specifically, as shown in FIG. 12, a silicone sealing ring is disposed at an edge of the baffle 121, and when the included angle between the baffle 121 and the axis of the air inlet channel 2 is 90 degrees, the silicone sealing ring abuts against an inner wall of the air inlet channel 2, so that the air inlet is completely closed.

In the present embodiment, as shown in FIG. 12, the first air supplement zone is in communication with a side of the baffle 121 in the air inlet channel 2 facing away from the stove body 1, and the second air supplement zone is in communication with a side of the baffle 121 in the air inlet channel 2 facing toward the stove body 1, so that when the baffle 121 closes the air inlet, the second air supplement zone cannot supplement air.

Optionally, as shown in FIGS. 5 and 6, the first air supplement zone is in communication with the connection end of the air inlet channel 2 via the first air supplement channel 4, an air supplement adjusting device 13 is arranged inside the stove body 1, and the air supplement adjusting device 13 may adjust the opening degree of the communicating port between the first air supplement channel 4 and the stove body 1. By employing such arrangement, the implementation of air supplement or the intensity of the air supplement can be adjusted according to the users' needs.

Specifically, as shown in FIGS. 5 and 6, the air supplement adjusting device 13 includes an adjusting plate 131 and a pull rod 132 which are connected to each other. The adjusting plate 131 may completely cover the communicating port between the first air supplement channel 4 and the stove body 1, the pull rod 132 extends from the front side of the stove body 1, and the extending portion is bent to form a zigzag structure to facilitate the user for pulling.

More specially, as shown in FIGS. 5 and 6, the first air channel 4 includes an ash box 41 and a first air supplement pipe 42 that are in communication with each other. The ash box 41 is disposed in a bottom of the stove body 1 and is in communication with the first air supplement zone via an opening in the bottom of the stove body 1. One end of the first air supplement pipe 42 is in communication with the connection end of the air inlet channel 2, and another end of the first air supplement pipe 42 is in communication with a side of the ash box 41. There is provided an ash tray 411 at the bottom of the ash box 41, the ash tray 411 being operative to open or close the opening in the bottom of the ash box 41. By employing such arrangement, the ash in the stove body 1 may be firstly introduced into the ash box 41 and then discharged by adjusting the ash tray 411.

Specifically, the ash tray 411 is rotatably disposed on the ash box 41, and a snap-fit is disposed on one side of the ash tray 411. A locking bolt matched with the snap-fit is disposed on the ash box 41, and when the snap-fit is clamped on the locking bolt, the locking bolt can be adjusted to fix the ash tray 411 to close the opening at the bottom of the ash box 41. When the ash needs to be discharged, the locking bolt is loosened, the ash tray 411 is rotated, and the opening at the bottom of the ash box 41 is opened, thereby discharging the ash.

Optionally, the second air supplement zone is in communication with the connection end of the air inlet channel 2 via the second air supplement channel 5, and the second air supplement channel 5 includes a plurality of second air supplement pipes 51. One end of each second air supplement pipe 51 is in communication with the connection end of the air inlet channel 2, the other end of each second air supplement pipe 51 extends into the stove body 1, and a side wall of the part of each second air supplement pipe 51 extending into the stove body 1 is provided with at least one air venting hole 511.

In the present embodiment, there are provided two second air supplement pipes 51 (the specific number of the second air supplement pipes 51 can be set according to the specification of the stove body and the specific use scene, and is not limited to two), and each air supplement pipe is provided with a plurality of air venting holes 511, so that air supplement in the second air supplement zone is more uniform.

Specifically, as shown in FIG. 5, a diameter of the second air supplement pipe 51 is smaller than that of the first air supplement pipe 42 to control the air supplement amount of the second air supplement area.

Optionally, the stove of the present disclosure further includes two casings 6, each of which is rotatably connected to the stove body 1, and the two casings 6 are symmetrically disposed at the top of the stove body 1. When fitted together, the two casings 6 encloses a closed baking space at the top of the stove body 1, and foods such as pizza can be baked in the baking space, thereby enlarging the application range of the stove. The two casings 6 open up after symmetrically expanded, and can be used for placing articles to make the casing 6 more practical.

Figure 7:
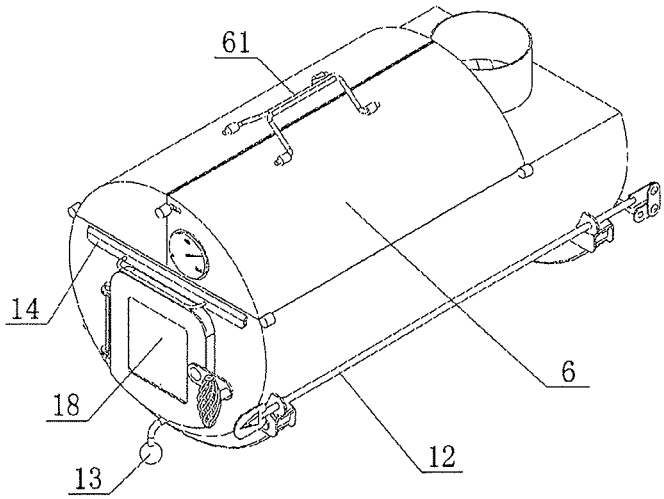
FIG. 7 is a schematic view observed from a perspective of a stove when closed according to an embodiment of the present disclosure.
Figure 8:
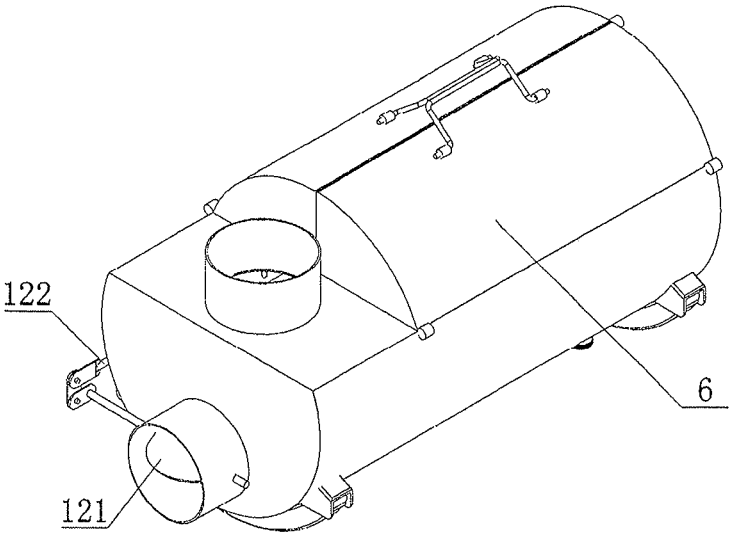
FIG. 8 is a schematic view observed from another perspective of a stove when closed according to an embodiment of the present disclosure.
Figure 9:
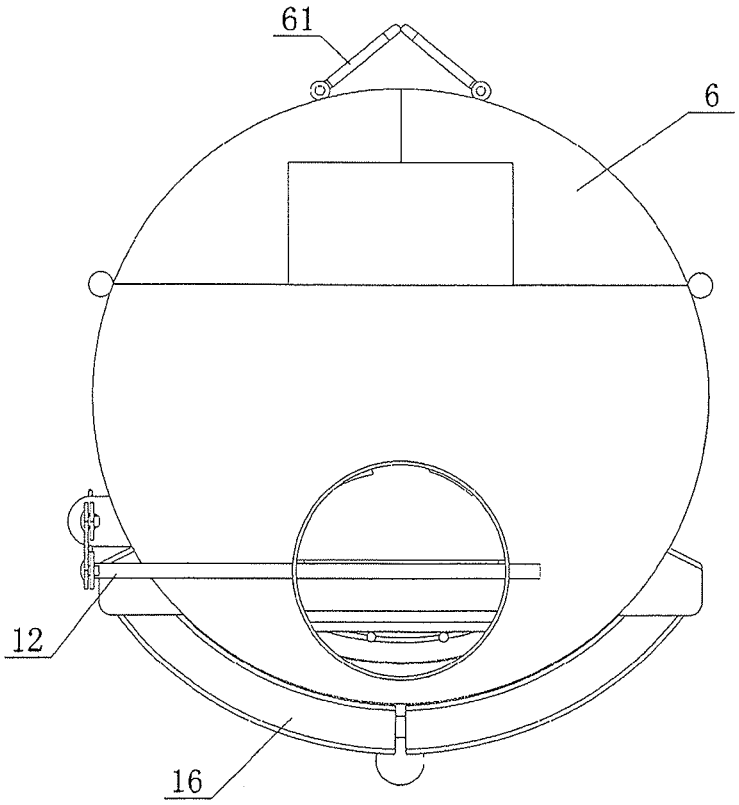
FIG. 9 is a schematic view of an end of a stove when closed according to an embodiment of the present disclosure.
Figure 10:
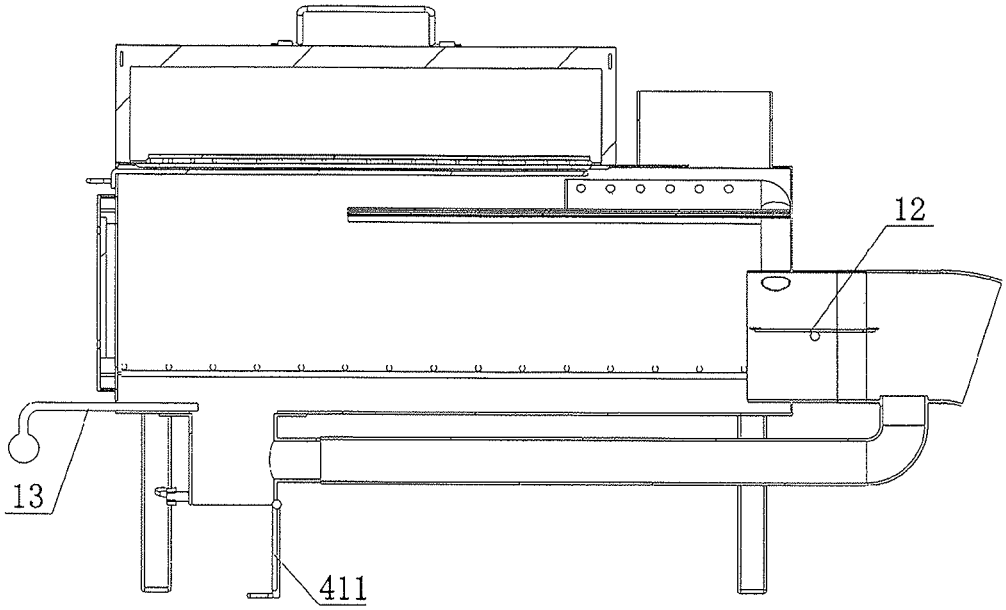
FIG. 10 is a sectional view of an air intake adjusting device, an air supplement adjusting device, and an ash tray that are completely opened in a stove according to an embodiment of the present disclosure.
Figure 11:
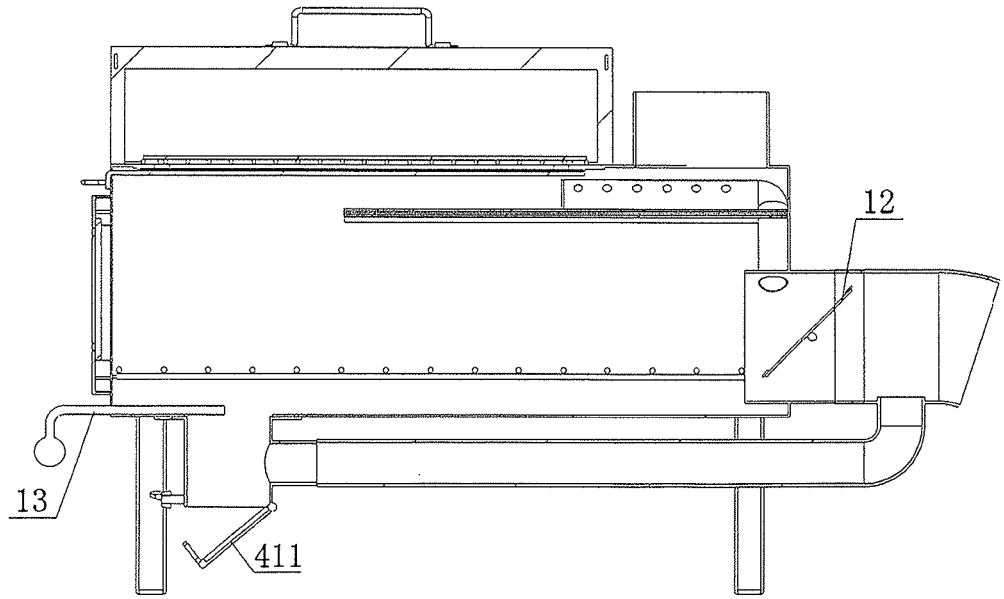
FIG. 11 is a sectional view of an air intake adjusting device, an air supplement adjusting device, and an ash tray that are partially opened in a stove according to an embodiment of the present disclosure.

Specifically, as shown in FIGS. 7, 8 and 9, the end of each casing 6 facing away from the stove body 1 is provided with a handle 61. When the two casings 6 are fitted together, the two handles 61 approach each other, and the user can hold the two handles 61 with one hand to lift up the stove.

More specifically, a thermometer is provided on one of the casings 6 so that the temperature in the baking space can be monitored during the baking operation.

Optionally, a horizontal elongated hole is defined in the front side of the stove body 1, and a stove cover 14 is inserted into the elongated hole, and the opening degree of a fire vent in a top surface of the stove body 1 can be adjusted by pulling the stove cover 14.

Specifically, when the stove cover 14 closes the fire vent, a part of the stove cover 14 is still located outside the stove body 1, and a rib plate is arranged on this part and abuts against the front side wall of the stove body 1, so that the stove cover 14 is prevented from totally sliding into the stove body 1. Furthermore, a handle is arranged on an end surface of the stove cover 14 facing away from a side of the stove body 1 to facilitate the user in pulling.

Figure 16:
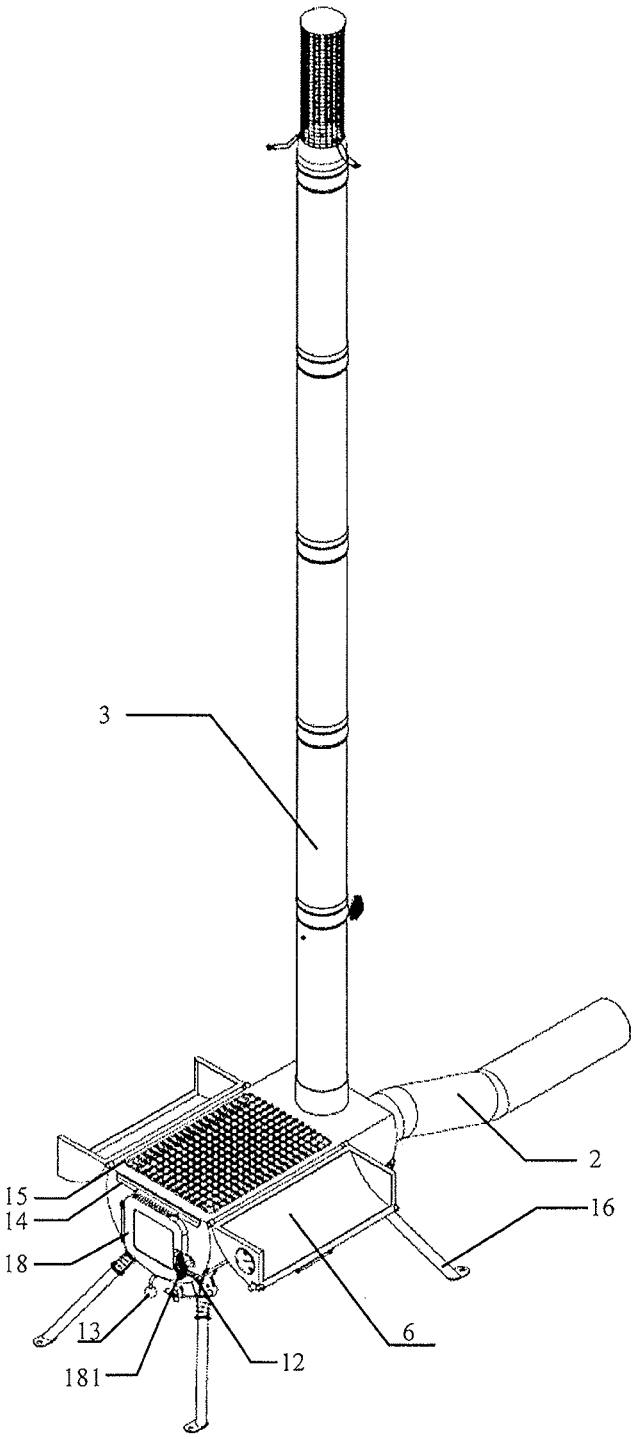
FIG. 16 is a schematic diagram illustrating a stove in which a stove cover is inserted into a stove body of the stove, and a baking net is fitted to a fire vent opened in a top surface of the stove body for illustrative purposes, according to an embodiment of the present disclosure.

Referring now to FIG. 16, there is shown a schematic diagram illustrating a stove in which a stove cover is inserted into a stove body of the stove, while a baking net is fitted to a fire vent opened in a top surface of the stove body for illustrative purposes, according to an embodiment of the present disclosure. Based on the configuration shown in FIG. 16, the stove cover or the baking net may be removed from the stove body for different heating purposes using the stove. See the following description for details.

Figure 17:
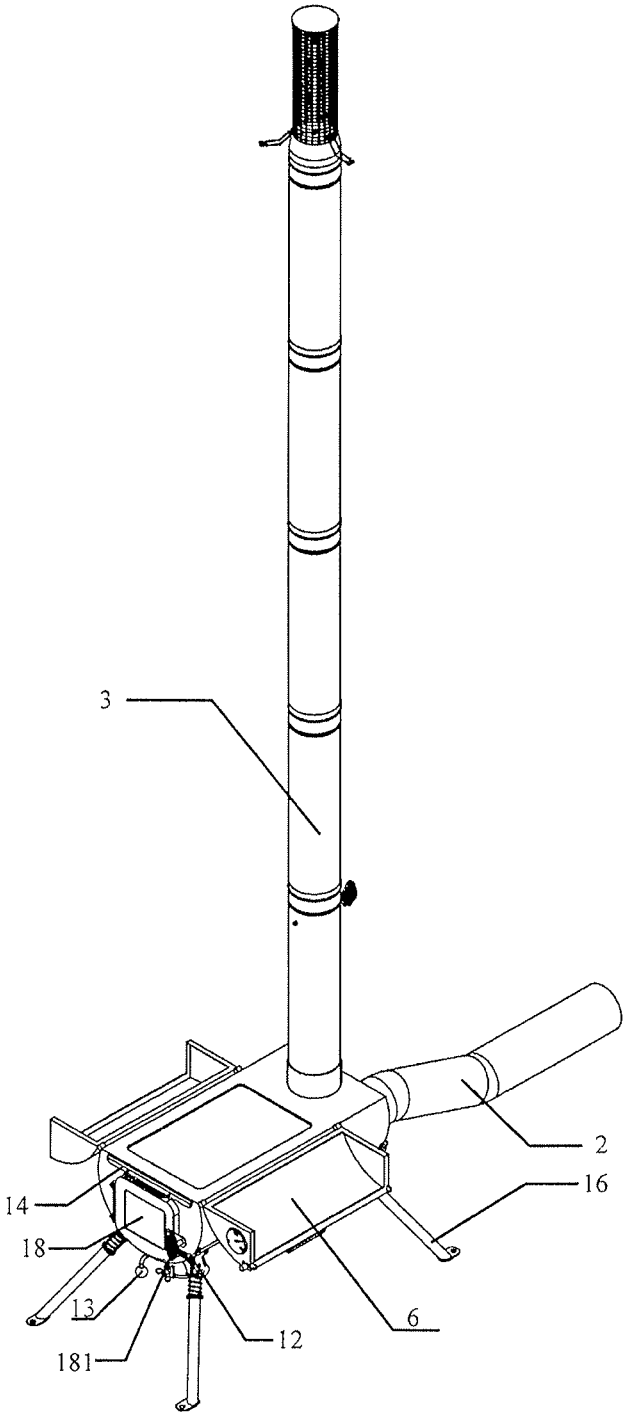
FIG. 17 is another schematic diagram illustrating the stove of FIG. 16 in which the stove cover is inserted into the stove body of the stove to seal up the fire vent opened in the top surface of the stove body while the baking net is removed from the stove body, according to an embodiment of the present disclosure.

As illustrated in FIG. 17 which shows a schematic diagram illustrating the stove of FIG. 16 where the stove cover is inserted into the stove body to seal up the fire vent while the baking net is removed from the stove body according to an embodiment, in particular, when the stove is used for a heating purpose such as heating a kettle (not shown) filled with water, then the stove cover 14 may be inserted into the stove body 1 via the elongated hole defined in the front side of the stove body 1 to let the rib plate abut against the front side wall of the stove body 1, such that the stove cover 14 is operative to totally seal up the fire vent in the top surface of the stove body 1 as well as the elongated hole. Then the user may open the stove door 18 and add fuel such as timber into the combustion chamber of the stove body and then ignite the fuel. When the fuel is able to be combusted on its own, the user may close the stove door 18 and snap-fit the free end of the stove door to the stove body 1 by the door handle 181. Thus, as the stove door 18 is closed to the stove body 1 and the stove cover 14 seals up the elongated hole and the fire vent while the fuel such as timber is burning inside the combustion chamber of the stove body 1, the exhaust gas that is produced from the combustion of the fuel won't leak from any one of the elongated hole that is defined in the front side wall of the stove body 1, the fire vent provided on the top surface of the stove body 1, and the stove door opening defined in the front side of the stove door 18.

It is to be noted that when the stove cover 14 is inserted into the stove body 1 to fully seal the fire vent defined in the top surface of the stove body 1, the stove provided by the present disclosure can be used for heating purposes in which the cookware is not needed to be in direct contact with the flames produced from the fuel combustion. For example, the stove can be used for heating a kettle filled with water to produce hot or boiling water which can be effectively disinfected and sterilized, making the water safe for drinking by the user. For another example, the stove can be used for heating dumplings that are placed in a piece of cookware such as a lunch box (not shown). The lunch box can be placed on the stove cover 14 while the fuel is burning inside the combustion chamber of the stove body 1. The heat produced from the combustion can be conducted to the lunchbox and the dumplings via the stove cover and thus heat the dumplings. Thereby, the user or users can enjoy warm water that is safe to drink and warm food in the wild. This is particularly favorable in low temperatures in the wild.

Optionally, when the stove is used for heating a kettle of water or heating a lunch box of dumplings as described supra, the two casings 6 can be fitted to form an enclosed heating space. The kettle or the lunch box can be placed in the enclosed space and heated therein.

Figure 18:
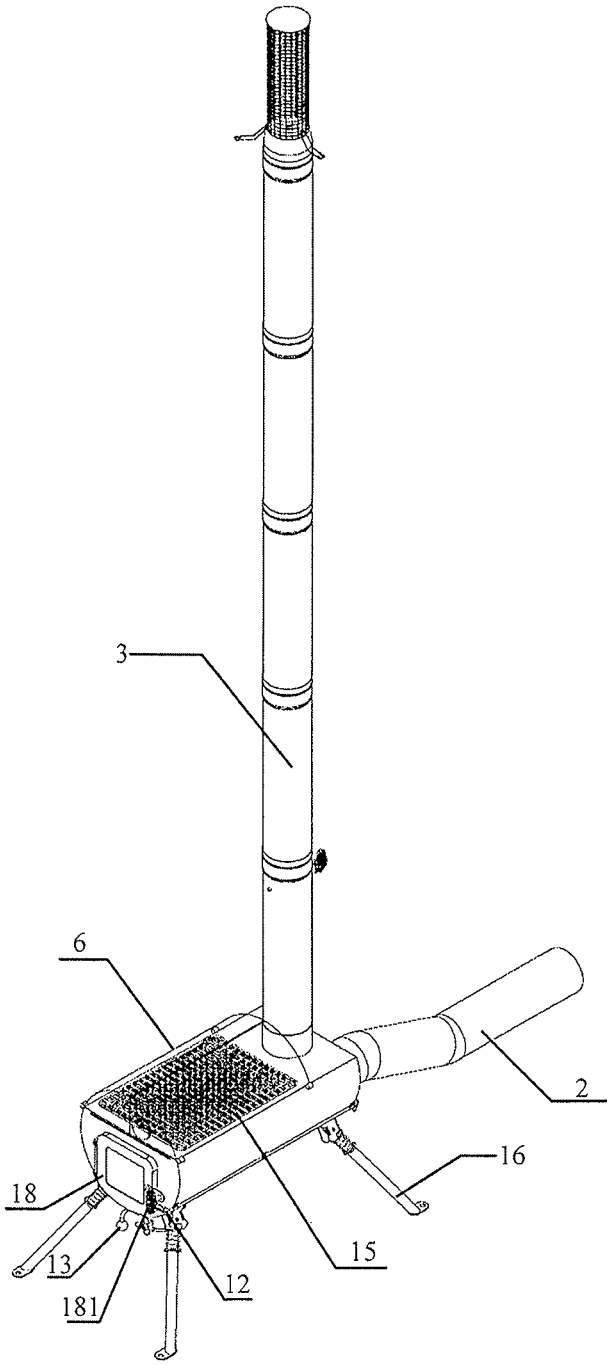
FIG. 18 is yet another schematic diagram illustrating the stove of FIG. 16 in which the stove cover is pulled off from the stove body of the stove while the baking net is fitted to the fire vent opened in the top surface of the stove body and the two casings are closed to form an enclosed baking space on top of the fire vent, where the two casings are seen through to display the baking net inside the enclosed baking space for illustrative purposes, according to an embodiment of the present disclosure.
Figure 19:
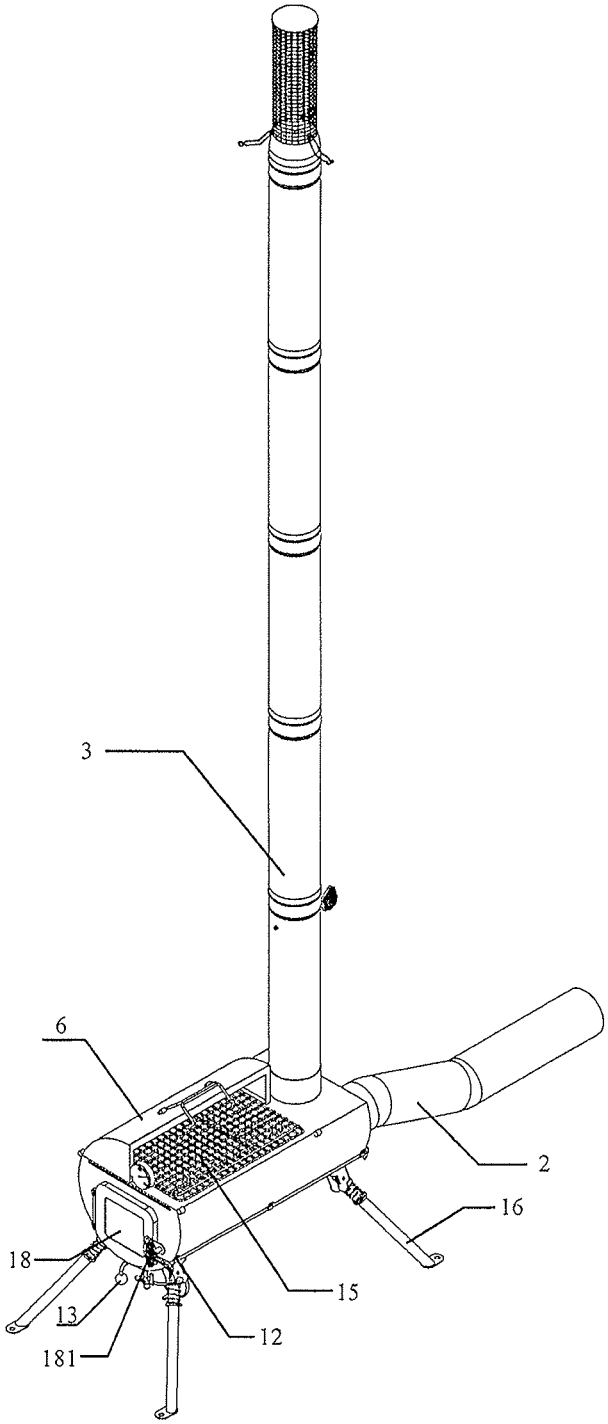
FIG. 19 is still another schematic diagram illustrating the stove of FIG. 18 in which the stove cover is removed from the stove body while the baking net is remained to be fitted to the fire vent, where the right casing of the two casings is removed to expose the baking net underneath for illustrative purposes, according to an embodiment of the present disclosure.
Figure 20:
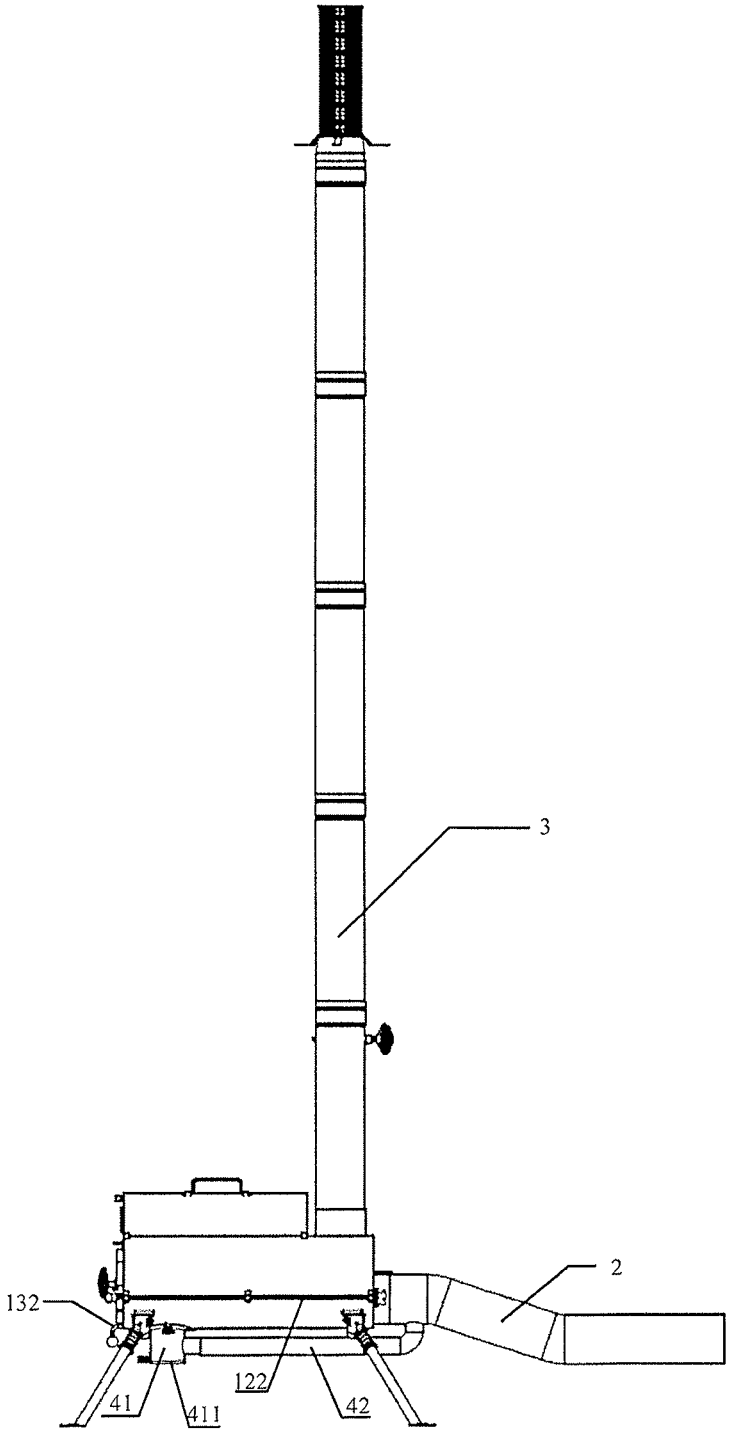
FIG. 20 is a right side view of a stove according to an embodiment of the present disclosure.
Figure 21:
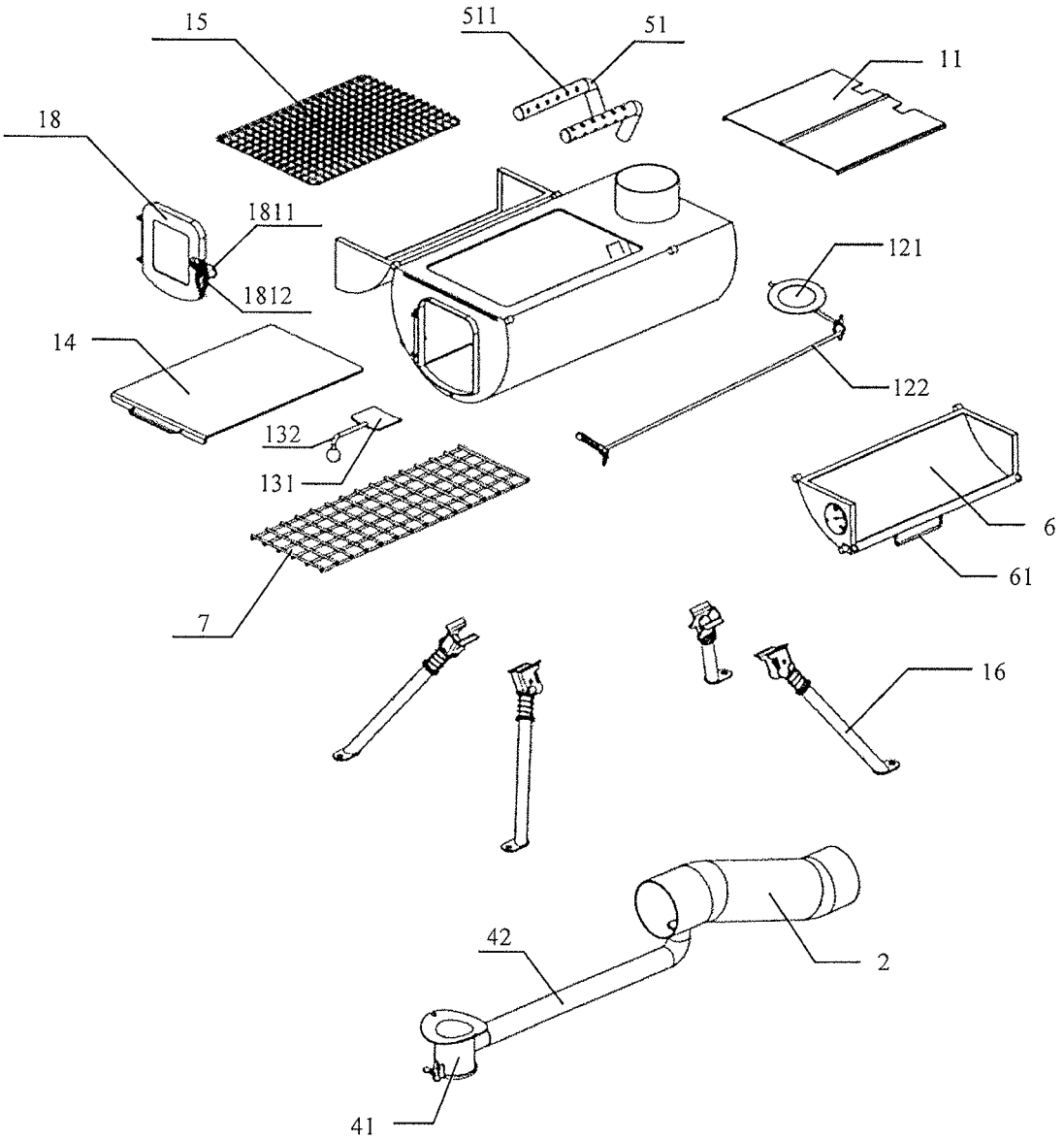
FIG. 21 is an exploded view of a partial structure of a stove observed from a perspective according to an embodiment of the present disclosure.

Furthermore, in addition to the above state in which the stove cover 14 is operative to seal up the fire vent and the elongated hole, the stove cover 14 may have another state as illustrated in FIG. 18, which shows a schematic diagram of the stove of FIG. 16 where the stove cover is pulled off from the stove body and put away while the baking net is fitted to the fire vent according to an embodiment. In particular, the stove cover 14 may be detached from the stove body 1 by being pulled off from the stove body via the elongated hole. But this only happens after the fuel such as timber has been sufficiently burnt to the degree that only charcoal is remained of the timber. At this moment, the charcoal may be sufficiently and stably burning to emit an apparent red color. Because only charcoal is remained and is sufficiently and stably burning, no smoke that is supposed to be produced from the combustion of wood would be produced from the combustion of the charcoal. In addition, no toxic gases such as carbon monoxide would be produced and leak into the inside of the enclosed space e.g. the tent, ensuring the safety of the user or users inhabiting the enclosed space. Then the stove body can be used for another purpose such as baking where the raw food is required to be in direct contact with the flames, whether it be an open flame or an invisible flame, produced from the combustion of the fuel in the combustion chamber. See the following description. More specifically, a baking net 15 is fitted onto the fire vent of the stove body 1, and when the fire vent is opened by pulling the stove cover 14, the baking net 15 can be covered on the fire vent to enable the stove of the disclosure to be used for barbecue.

Thus, from the above description, it is particularly noted that the stove cover 14 should not be pulled off from the stove body 1 unless the stove is used for baking purposes. In other words, the stove cover 14 should always be inserted into the stove body 1 via the elongated hole defined in the front side of the stove body 1 and let the rib plate arranged on the part of the stove cover located outside the stove body to abut against the front side wall of the stove body 1, so that the stove cover 14 is operative to seal up both the fire vent defined in the top surface of the stove body 1 and the elongated hole defined in the front side of the stove body 1. Thereby, the combustion products of the fuel such as timber can be prevented from leaking into the enclosed space in which the user or users are living through the fire vent or the elongated hole, effectively ensuring their safety. Only when the stove is used for baking purposes where the raw food to be baked or roasted is required to directly contact the flames of the burning fuel can the stove cover 14 be pulled off from the stove body 1. More particularly, the stove can be used for baking purposes only when the fuel such as timber is combusted to the degree that only charcoal is remained of the timber and is burning in a sufficient and stable manner. Because the remained charcoal is burning sufficiently and stably, no smoke would be produced, and more importantly no toxic gases such as carbon monoxide would be produced, thereby effectively ensuring the safety of the inhabiting user or users. In other words, when the user observes into the stove body from the stove door 18 that the timber has been sufficiently burnt to the degree that only charcoal is remained, the user then can fit the baking net 15 onto the fire vent of the stove body, and then pull off the stove cover 14 from the stove body 1 in order to open the fire vent. Then foods such as raw chicken meat can be placed on the baking net 15 to be baked.

Optionally, when the stove is used for a baking purpose as described above, the two casings 6 can be fitted together to enclose a closed baking space at the top of the stove body 1, and foods such as a pie of pizza or raw chicken meat can be placed in the closed baking space to be baked.

It is to be appreciated that although the stove cover, when fully inserted into the stove body, is able to seal up the fire vent opened in the top of the stove body 1 as well as the elongated hole defined in the front side of the stove body 1, the sealings may still have chances of failing due to various factors such as wear and tear, aging, and the like of the materials. In these cases where the materials that make up the stove cover and the stove body may be worn by cumulative friction with each other after many times of being pulled and pushed, the stove cover and stove body would no longer be tightly fitted with each other, thus giving way to leakages.

In view of this, it is appreciated that in some embodiments the stove cover 14 might be integrally formed with the stove body 1. That is, the stove cover 14 is no longer a detachable part that can be pulled off and pushed into the stove body 1, but is integrally molded with the stove body 1 during manufacturing, so that the stove cover 14 is actually an integral part of the stove body and would form a smooth heating surface on the top of the stove body 1 on which a piece of cookware can be placed for heating purposes. As such, the elongated hole and fire vent described above would not be present in this configuration of the stove, hence no chances of failure of the sealings between the stove cover 14 and the stove body 1. Optionally, four legs 16 are rotatably provided on a bottom surface of the stove body 1, two legs 16 are symmetrically provided near the front side of the stove body 1, and the other two legs 16 are symmetrically provided near the rear side of the stove body 1. When unfolded, the four legs 16 can support the stove body 1, and when folded, the four legs 16 are the four legs 16 are all attached to the bottom surface of the stove body 1.

Specifically, as shown in FIG. 9, the bottom surface of the stove body 1 is an arc-shaped surface, and the legs 16 are arc-shaped rods and are fitted to the bottom surface of the stove body 1, so that the legs 16 can better attach to the stove body 1 when folded, so that the stove would occupy an even smaller volume when folded.

Optionally, a mesh-shaped fuel grate 17 is provided inside the stove body 1 and is installed in parallel to the horizontal plane, and can be stacked with fuel.

Optionally, as shown in FIG. 1, the exhaust channel 3 includes a tubular body 31 and a chimney protector 32 sleeved outside the tubular body 31. A bottom end of the tubular body 31 is in communication with the exhaust port of the stove body 1, and a top end of the tubular body 31 extends out of the enclosed space and is in communication with the outside. The chimney protector 32 and the tubular body 31 are spaced apart to form a heat dissipation cavity, and a top end of the chimney protector 32 is sealedly connected to the tubular body 31.

In mounting, the chimney protector 32 may be mounted on a member penetrated by the tubular body 31, such as a roof, a side wall of a house, a top portion of a tent, etc., so that the tubular body 31 is isolated from other members, thereby preventing the tubular body 31 from burning other members or causing a fire due to an excessively high temperature. The heat dissipation cavity helps to effectively insulate heat and can dissipate heat. The top end of the chimney protector 32 is sealedly connected to the tubular body 31 to prevent rainwater or other foreign materials from entering. Here, the chimney protector 32 may be made of a non-flammable, relatively fast heat dissipating material, such as ceramic. Further, in order to prevent dust and water for entering, the top end of the chimney protector 32 is provided as an inclined surface along which rainwater and foreign materials can easily slide down.

Specifically, the chimney protector 32 is connected to a non-heat-resistant enclosed space outer wall material such as a tent via a silicone protector 33 sleeved outside the chimney protector 32. The silicone protector 33 is provided with a clamping member such as a bolt, and the tent cloth can be clamped between the clamping member and the silicone protector 33. The above-mentioned silicone protector 33 is a ring sleeve made of silicone and is a conventional device in the present field, and is not described herein again.

More specifically, a plurality of air venting holes are opened in the circumferential outer wall of the chimney protector 32, and the plurality of air venting holes are in communication with the heat dissipation cavity. The air venting hole facilitates the circulation of air, and the plurality of air venting holes can form a convection current between each other to facilitate the dissipation of heat. The positions and number of the air venting holes arranged are not limited herein.

In the present embodiment, the top end of the chimney protector 32 is connected to the tubular body 31, and the bottom end of the chimney protector 32 is provided with an opening communicating with the heat dissipation cavity. The air venting hole may be concentrated on the outer wall away from the opening, and the convection current is formed between the air venting hole and the opening. In mounting, an end provided with the air venting hole can be configured to extend outdoors, and an end provided with the opening is disposed indoors. The air entering via the air venting holes cools the tubular body 31 when passing through the heat dissipation cavity.

Specifically, the chimney protector 32 may be welded, screwed, or snap-fitted to the tubular body 31, which however is not limited herein.

Figure 13:
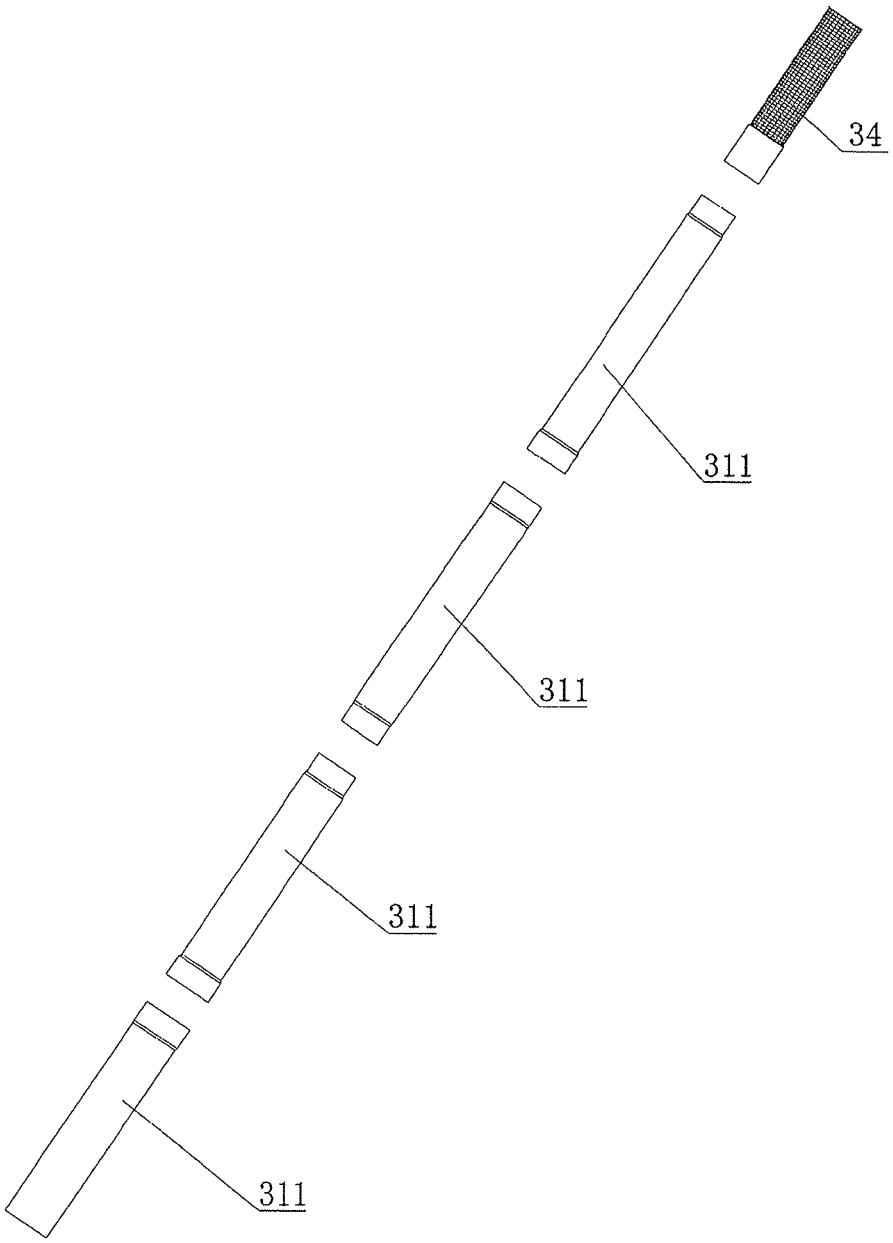
FIG. 13 is an exploded view of tubular segments and a flame arrester in a stove according to an embodiment of the present disclosure.

More specifically, as shown in FIG. 13, the tubular body 31 is configured as a detachable multi-section tubular segment 311, and the chimney protector 32 is welded with one section of the tubular body 311 to form a whole, ensuring the firmness of the chimney protector 32, and reducing the mounting process.

Specifically, one end of each tubular segment 311 is provided with a flared opening, and adjacent tubular segments 311 are snap-fitted to each other. An end of the tubular segment 311 facing away from the flared opening is provided with a chamfer to facilitate the guiding. In mounting, an end with a chamfer on the tubular segment 311 is inserted into a flared opening of another tubular segment 311, and the two tubular segment 311 are inserted and clamped tightly due to the fact that an inner diameter of the flared opening is equal to or slightly greater than an outer diameter of the tubular segment 311.

Figure 14:
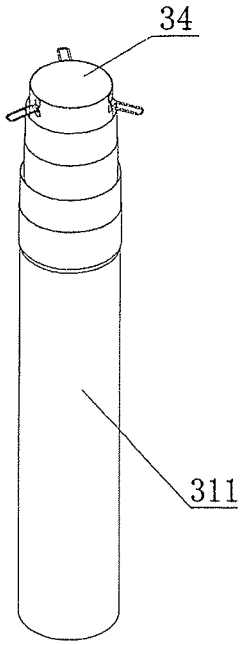
FIG. 14 is exploded schematic view of tubular segments and a flame arrester that are assembled together in a stove according to an embodiment of the present disclosure.

More specifically, as shown in FIG. 14, an outer diameter of a main body portion of each of the tubular segments 311 and an outer diameter of the flared opening are gradually reduced from bottom to top, so that the flared opening ends of the plurality of tubular segments 311 can be suited together from outside to inside when located on the same side.

More specifically, an end of the tubular segment 311 provided with the flared opening is further provided with a hollow protrusion. And the protrusion is disposed to make the outer wall of the tubular body 31 have a certain resilience, so that the two tubular segment 311 are connected more firmly.

In the present embodiment, the top end of the tubular body 31 is provided with a flame arrester 34. The flame arrester 34 includes a steel mesh arranged in the circumferential direction and an end cover arranged on the top end of the steel mesh. The smoke produced from the combustion in the stove body 1 can emerge from the small holes of the steel mesh, but burning sparks can be extinguished when meeting the steel mesh, so that the tent or surrounding inflammable objects such as leaves and the like cannot be ignited, and the safety performance is improved for the use of the stove. The end cover is provided to prevent rainwater or foreign materials from entering the tubular body 31 from the top end.

Specifically, the flame arrester 34 further includes a supporter located at a lower end of the steel mesh, the supporter is connected to the tubular body 31, and the connection may be a screwed connection or an inserted connection between the two tubular segments 311, and is not limited herein. A plurality of hanging rings are arranged around the circumference of the outer wall of the supporter. In picnic, one end of a fixing rope may be connected to the hanging ring, and another end may be connected to a ground nail, or the fixing rope pass through the hanging ring, and both ends of the fixing rope are connected to the ground nail. The chimney can be fixed to keep in a vertical state, so that it can smoothly discharge smoke and be prevented from being blown down by wind.

More specifically, the tubular body 31 is provided with a flow adjusting device 35 for adjusting air flow area inside the tubular body 31. For the convenience of manual adjustment, the flow adjusting device 35 is arranged at the lower portion of the tubular body 31 close to the stove body 1. The flow adjusting device 35 includes a sealing plate rotatably arranged in the tubular body 31 and an adjusting handle disposed outside the tubular body 31, and the adjusting handle is detachably connected to the sealing plate. A size of the sealing plate is matched with the inner diameter of the tubular body 31, the sealing plate can be driven to rotate by rotating the adjusting handle, so as to adjust the opening degree of the sealing plate, the flow area of the smoke is controlled, and therefore a size of the flame and burning speed are adjusted.

In the present embodiment, the adjusting handle includes a rod body and a grip 1812 located at an end of the rod body, the rod body is connected to the sealing plate, a clamping spring is sleeved on the rod body of the adjusting handle, and the clamping spring is clamped between the grip 1812 and the tubular body 31. Due to abutting action of the clamping spring, when the grip 1812 is rotated to drive the sealing plate to a certain position, the sealing plate can be fixed at the position under the action of the force of the clamping spring. Certainly, other means for locking the adjusting handle may be adopted, for example, the adjusting handle and the tubular body 31 are secured by a screw or a pin when the grip 1812 is rotated to drive the sealing plate to a certain position.

Specifically, the tubular body 31 is provided with a mounting hole, the mounting hole is provided with a pad column, the rod body of the adjusting handle runs through the pad column, and the clamping spring is disposed in the pad column. The rod body of the adjusting handle is connected to the sealing plate via a locking pin.

In the present embodiment, the chimney, the flow adjusting device 35, and the flame arrester 34 can all be detached and placed in the inner cavity of the stove body 1 to facilitate the portability.

Optionally, a stove door 18 is detachably arranged at a stove mouth at the front side of the stove body 1, one end of the stove door 18 is rotatably connected to the stove body 1 through the fitting of a screw rod and a nut, and the other end of the stove door 18 is snap-fitted to the stove body 1 by a door handle 181. The stove door 18 is detachably arranged to facilitate replacement in cases of failure, preventing damage to the stove door 18 from rendering the entire stove unusable.

Specifically, an end of the stove door 18 is provided with a first mounting hole, and the stove body 1 is correspondingly provided with a second mounting hole. The screw rod passes through the first mounting hole and the second mounting hole, one end of the screw rod is limited by means of its head, and another end of the screw rod is connected to the nut. The screw rod and the nut are not completely locked when connected, so that the stove door 18 has a room for rotating.

More specifically, there are provided with two first mounting holes and two second mounting holes, and the two second mounting holes are located between the two first mounting holes.

Optionally, the door handle 181 includes a latch piece 1811 and a grip 1812 disposed at an end of the latch piece 1811. An end of the latch piece 1811 is rotatably connected to the stove door 18, and the stove body 1 is provided with a clamping slot corresponding to the latch piece 1811, and when the stove door 18 is closed, the latch piece 1811 can be interlocked with the clamping groove to lock the stove door 18.

Specifically, the stove door 18 is detachably provided with a glass window, and the glass window is arranged to facilitate observation of the internal condition of the stove body 1. When it is damaged, the glass window is convenient to be replaced in time. A frame is arranged on the stove door 18, and an opening is defined at an end of the frame, so that the glass window can be conveniently mounted, and the glass window is located between the frame and the stove door 18. An end inside the frame facing away from the opening is provided with a spring piece, a baffle is arranged at a side of the glass window after the glass window is mounted, and the spring piece and the baffle work in conjunction to protect the glass window. A side of the baffle facing away from the glass window is provided with a limiting screw, and the limit screw is screwed on the stove door 18 and abuts against the baffle to limit the baffle, thereby preventing the glass window from being separated.

Figure 15:
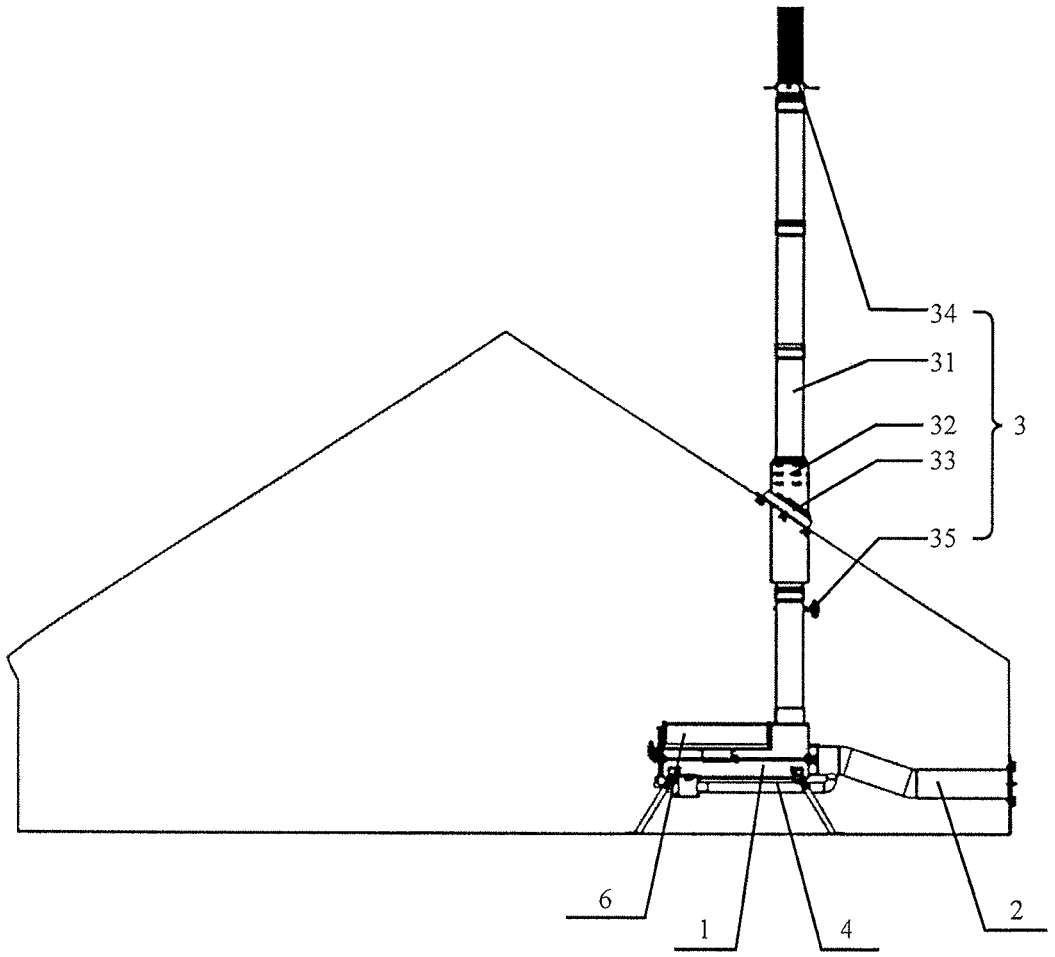
FIG. 15 is a schematic diagram illustrating a stove placed in an enclosed space according to an embodiment of the present disclosure.

FIG. 15 shows a schematic diagram illustrating a stove in an enclosed space according to an embodiment of the present disclosure. The stove includes a stove body, an inlet channel 2, and an exhaust channel 3. When the stove body is used in an enclosed space such as a tent in the wild, an air inlet end of the air inlet channel 2 is in communication with an outside of the enclosed space, and a connection end of the air inlet channel 2 is in communication with an air inlet of the stove body 1, such that the air inlet channel 2 is operative to introduce external air into the stove body 1 from the outside of the enclosed space. A connection end of the exhaust channel 3 is in communication with an exhaust port of the stove body 1, an exhaust end of the exhaust channel 3 is in communication with the outside of the enclosed space, such that the exhaust channel 3 is operative to discharge an exhaust gas from the stove body out of the enclosed space.

Referring also to FIGS. 16, 21, and 23-26, the stove according to this embodiment differs from the foregoing embodiments in that the openability of a stove door 18 of the stove is associated with an opening degree of the air inlet of the stove body 1. In particular, only when the air inlet of the stove body 1 is totally closed, namely when the opening degree of the air inlet is 0%, the stove door 18 is openable. Otherwise, when the air inlet is opened, no matter the opening degree, the stove door 18 is prevented from being opened as long as the opening degree of the air inlet is greater than 0%. As such, the problem can be effectively solved that when the user opens the stove door 10 to add fuel such as timber into the combustion chamber of the stove, the exhaust gas produced from the combustion in the combustion chamber would leak into the enclosed space such as the inside of the tent in which the stove is used such that the user or users inside the tent would be choked or even poisoned by the products of incomplete combustion, leaving the user or users' lives in danger. The specific implementation of this mechanism is however not limited herein, as long as the openability of the stove door 18 is associated with the opening degree of the air inlet and the stove door 18 can only be opened when the air inlet is totally closed namely the opening degree of the air inlet is 0%, it shall fall in the scope of protection of the present disclosure.

Figure 23:
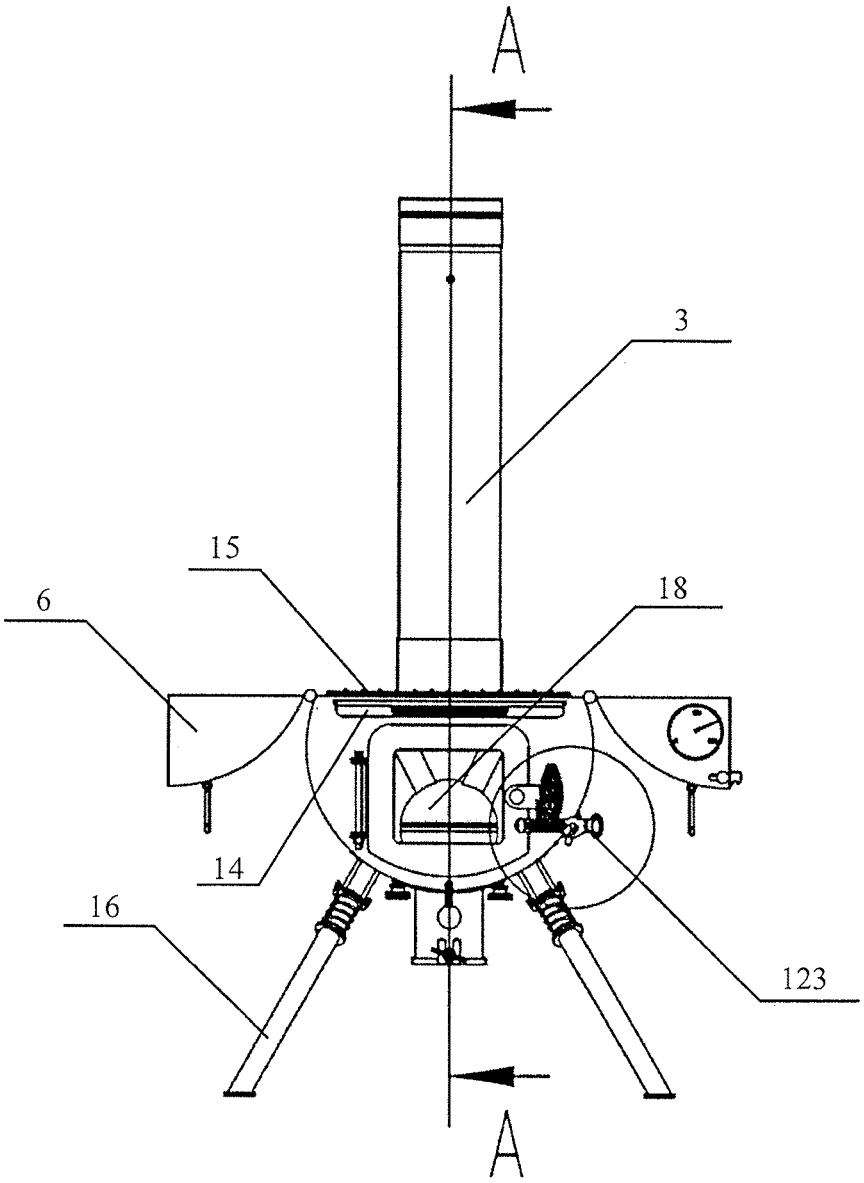
FIG. 23 shows a front view of a stove in a first state of use in which external air is allowed to enter a combustion chamber of the stove and a stove door of the stove is unopenable according to an embodiment of the present disclosure.
Figure 24:
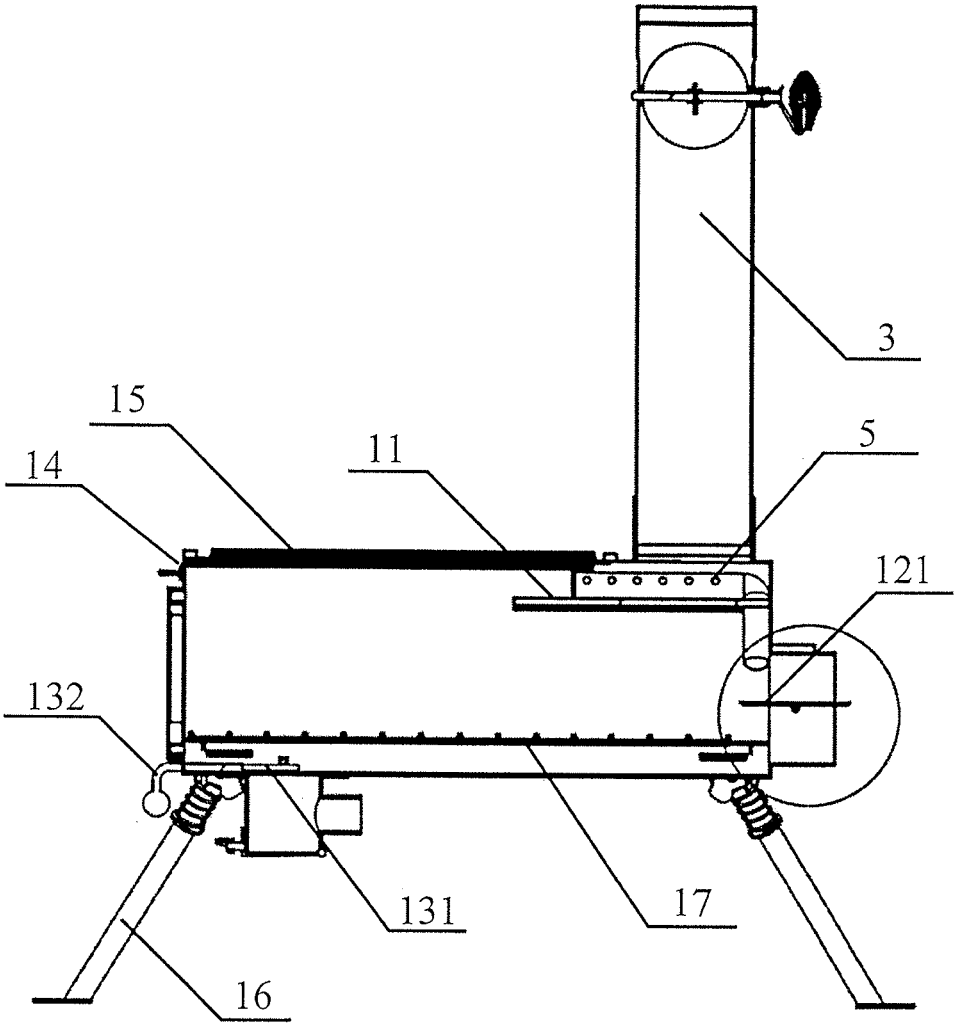
FIG. 24 is a sectional view of the stove of FIG. 23 taken along line AA shown in FIG. 23.
Figure 25:
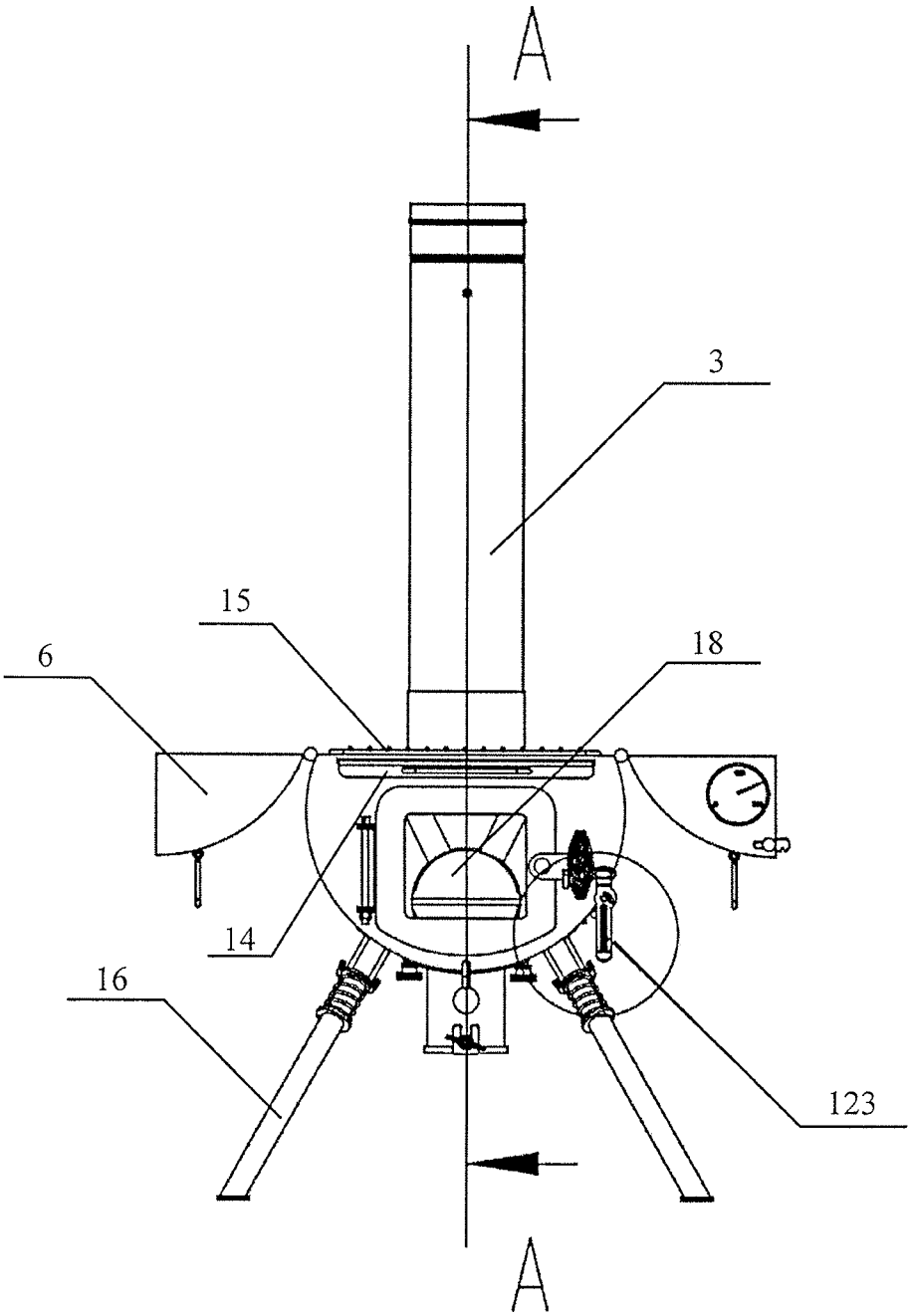
FIG. 25 shows a front view of the stove in a second state of use in which external air is prevented from entering the combustion chamber of the stove and a stove door of the stove is openable according to an embodiment of the present disclosure.
Figure 26:
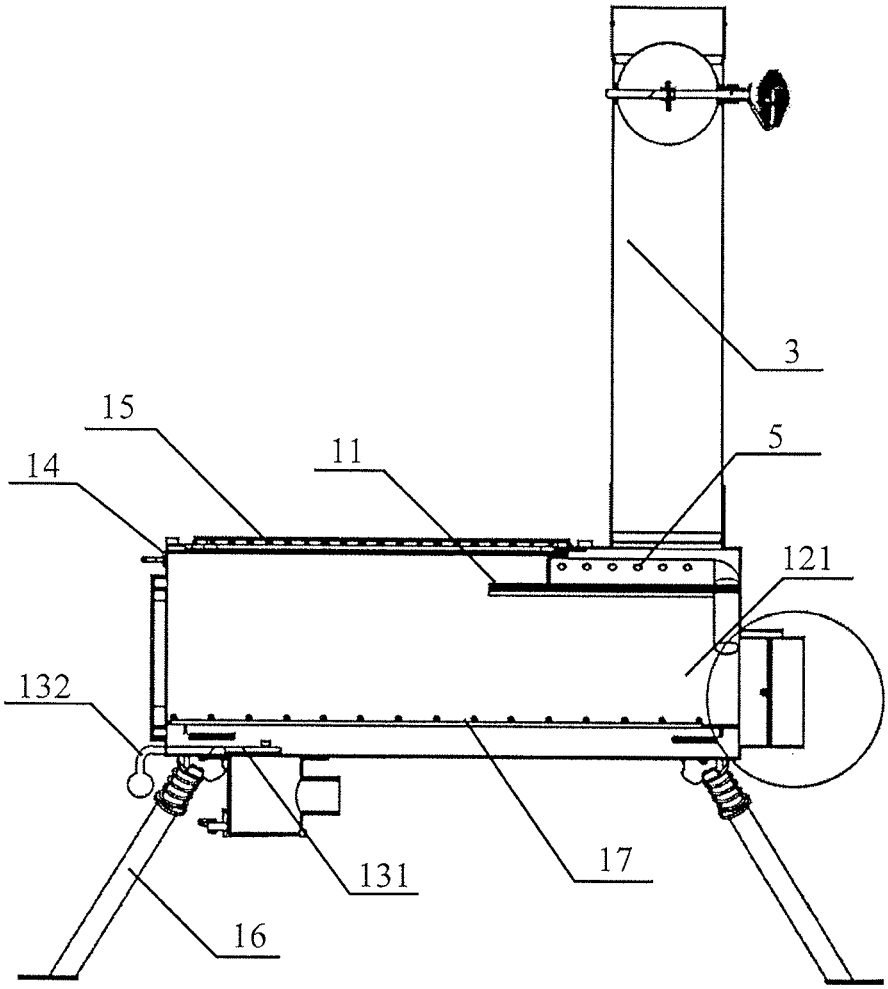
FIG. 26 is a sectional view of the stove of FIG. 25 taken along line AA shown in FIG. 25.
Figure 27:
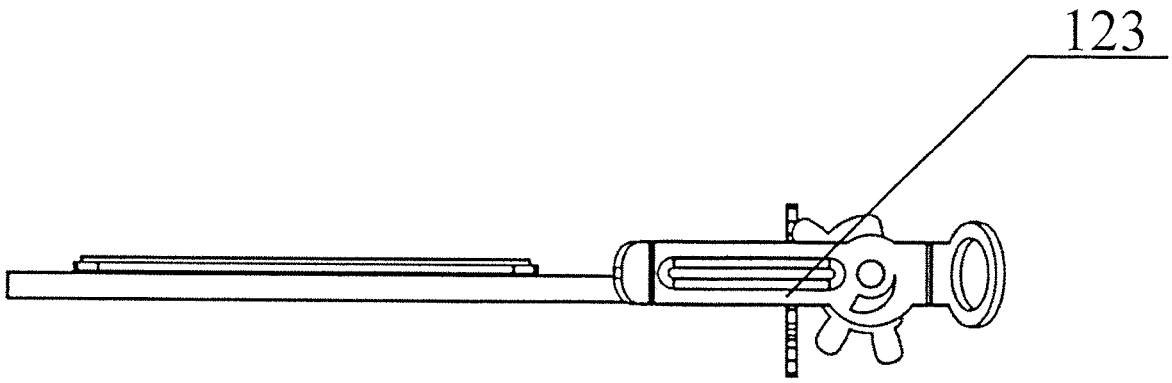
FIG. 27 is a schematic diagram illustrating an air intake adjusting device of a stove in a first state of use in which a baffle of the air intake adjusting device is opened and external air is allowed to enter a combustion chamber of the stove according to an embodiment of the present disclosure.
Figure 28:
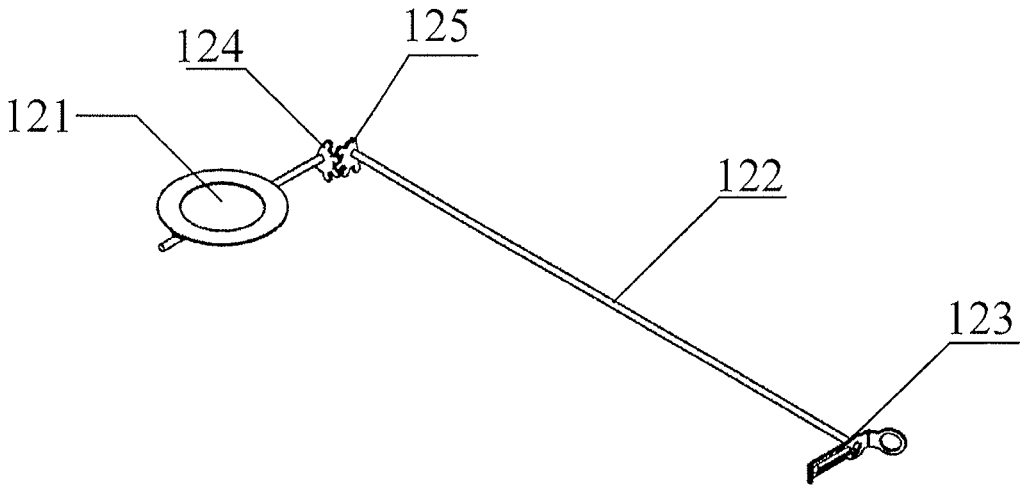
FIG. 28 is a perspective view of the air intake adjusting device of FIG. 27.

In some embodiments, as illustrated in FIGS. 23-28, where FIG. 23 shows a front view of a stove in a first state of use in which external air is allowed to enter the combustion chamber of the stove and a stove door of the stove is unopenable according to an embodiment of the present disclosure, and FIG. 25 shows a front view of the stove in a second state of use in which external air is prevented from entering the combustion chamber of the stove and a stove door of the stove is openable according to an embodiment of the present disclosure. Both in the first state of use and in the second state of use of the stove as illustrated in FIGS. 23 and 25, the air intake adjusting device as illustrated in FIGS. 27 and 28 may be adopted.

FIG. 27 illustrates an air intake adjusting device of a stove according to an embodiment of the disclosure, and FIG. 28 shows a perspective view of the air intake adjusting device of FIG. 27. As illustrated in FIGS. 27 and 28, the air intake adjusting device is configured to adjust an opening degree of an air inlet of the stove body 1 of the stove according to the present disclosure. As an alternative to the air intake adjusting device illustrated in FIGS. 1 to 15, the air intake adjusting device according to this embodiment includes a baffle 121, an adjusting rod 122, an operating bar 123, a first gear 124, a second gear, and a rotating shaft. The first gear 124 is fixedly connected to one end of the rotating shaft with an plane of the first gear 124 arranged perpendicular to the rotating shaft, the other end of the rotating shaft is connected to the baffle 121. The second gear 125 is fixedly connected to one end of the adjusting rod 122 with a plane of the second gear 125 arranged perpendicular to the adjusting rod 122. The first gear 124 and the second gear 125 are engaged with each other and the plane of the first gear 124 is set perpendicular to the plane of the second gear 125, such that the rotating shaft is also perpendicular to the adjusting rod 122. It is to be noted that the first gear 124 and the second gear 125 are not limited to the perpendicular relationship described herein, and in other embodiments the plane of the first gear 124 and the plane of the second gear 125 may also form other angles the lie in the range of 0-360 degrees other than 90 degrees, as long as a torsion exerted by a user at the adjusting rod 122 is able to be transmitted to the baffle 121 via the engagement of the first gear 124 and the second gear 125. The operating bar 123 is fixedly connected to the other end of the adjusting rod 122.

Turning back to FIG. 23, where the stove is the first state of use, in which external air is allowed to enter the combustion chamber of the stove and the stove door 18 of the stove is unopenable. With combined reference to FIGS. 27 and 28, in the first state of use of the stove, the plane of the baffle 121 is substantially parallel to a longitudinal axis of the air inlet, exactly as the state illustrated in FIGS. 27 and 28. More specifically, if the stove 1 is placed on a horizontal plane so that the longitudinal axis of the air inlet 1 would be substantially parallel to the horizontal plane, in the first state of use of the stove the baffle 121 would be substantially parallel to the horizontal plane. Because when the baffle 121 is posed parallel to the longitudinal axis of the air inlet, air outside the enclosed space is not blocked by the baffle 121 so that the outside air can freely enter the combustion chamber of the stove body 1 via the air inlet. At the same time, observed right from the front side of the stove body 1, namely directly facing the stove door 18, the operating bar 123 points to the immediate left such that it is at a horizontal position and blocks the stove door 18 from being opened. That is, in the first state of use, the external air outside of the enclosed space is allowed to freely enter the combustion chamber of the stove body 1 while the stove door 18 is blocked by the operating bar 123. Thus, the combustion products produced from the combustion inside the combustion chamber can be prevented from leaking into the enclosed space in which the user lives, ensuring the user's safety.

It should be noted that the first state of use of the stove should be understood in a broad sense; that is, in the first state of use, the baffle 121 is not limited to being totally parallel to the longitudinal axis of the air inlet, it can also form other angles with the longitudinal axis of the air inlet. Actually, when the baffle 121 is parallel to the longitudinal axis of the air inlet, the baffle 121 substantially constitutes no resistance to the air flow, which means the opening degree of the air inlet is 100%. Thus, in the first state of use of the stove, the baffle 121 can form other angles with the longitudinal axis of the air inlet, where the angles may lie in the range of 0-90 degrees, with 90 excluded. That is, when the baffle 121 forms an angle with the longitudinal axis of the air inlet that is greater than 0 degrees and less than 90 degrees, the stove is still in the first state of use, in which though the opening degree of the air inlet is less than 100%, it is greater than 0%, so that air is still allowed to enter the combustion chamber to support the combustion, only at lower rates. At the same time, the operating bar 123 would vary its angle with the width of the stove door 18. It is easily understood that the angle formed between the baffle 121 and the longitudinal axis of the air inlet is equal to the angle formed between the width of the stove door 18 and the operating bar 123. Since the operating bar 123 moves synchronously with the baffle and the baffle 121 is limited to move back and forth between a full-open position (where the angle between the baffle and the longitudinal axis of the air inlet is 0 degrees) and a full-closed position (where the angle between the baffle and the longitudinal axis of the air inlet is 90 degrees), the operating bar 123 is also limited to move within the range from the position parallel to the width of the stove door 18 (0 degrees) to the position perpendicular to the width of the stove door 18 (90 degrees). Intuitively, when the user stands right in front of the stove door 18, he may observe that the operating bar 123 is confined to move in the range of 9 o'clock (0-degree or full-open position) to 12 o'clock (90-degree or full-closed position).

Turning now to FIG. 25, where the stove in the second state of use, in which external air outside of the enclosed space is not allowed to enter the combustion chamber of the stove and a stove door of the stove is openable. Also with combined reference to FIGS. 27 and 28, in the second state of use of the stove, the plane of the baffle 121 is substantially perpendicular to the longitudinal axis of the air inlet. This is the position where the baffle 121 is posed when the baffle 121 rotates from the horizontal position (parallel to the longitudinal axis of the air inlet) illustrated in FIGS. 27 and 28 (hence substantially invisible in the figures, only the edge is visible), to a vertical position perpendicular to the longitudinal axis of the air inlet, where the plane of the baffle 121 directly faces the reader. At the same time the baffle 121 is at this position perpendicular to the longitudinal axis of the air inlet, the operating bar 123 is also perpendicular to the width of the stove door 18, or in other words referring to FIG. 27, perpendicular to the horizontal plane. Only at this position, the stove door 18 is not blocked by the operating bar 123, and so is allowed to be opened by the user. Note that though the stove door 18 is not confined by the operating bar 123, the stove door 18 may still be locked by door handle 181, and the user needs to lift the door 181 to unlock it from the stove body 1 in order to finally open the stove door 18 and subsequently add fuels such as timber into the combustion chamber of the stove body 1. That means, the operating bar 123 is used to serve as another safety measure aimed at improving the safety of using the stove within an enclosed space such as the inside of a tent in the wild. As such, the user can be prevented from inadvertently opening the stove door 18 with the air inlet still open such that the combustion products, usually poisonous gases such as mono dioxide resulting from the incomplete combustion of carbon, would leak into the enclosed space via the opened stove door 18, seriously endangering the user's health, even leaving the user's life at risk.

On the contrary, on the condition that the operating bar 123 is not at the upright position where the operating bar 123 is perpendicular to the width of the stove door 18, when the user wants to open the stove door 18 to add fuels so that he holds and lifts up the grip 1812 unlocking the door handle 181 from the stove body 1, he would find that he is unable to open the stove door 18 because the stove door 18 is further confined by the operating bar 123.

In some embodiments, the operating bar 123 may make a point contact with the stove door 18. In particular, the inner side of the operating bar 123 that contacts the stove 18 may be upheaved to form a bump or protrusion. In particular, the bump or protrusion may be tapered toward the stove door 18 so that the operating bar 123 would contact the stove door 18 at a tapered point. By this design, the heat transferred from combustion chamber to the operating bar 123 via the stove door 18 is kept to a minimum, so that the user's hand can be protected from being scalded.

Figure 22:
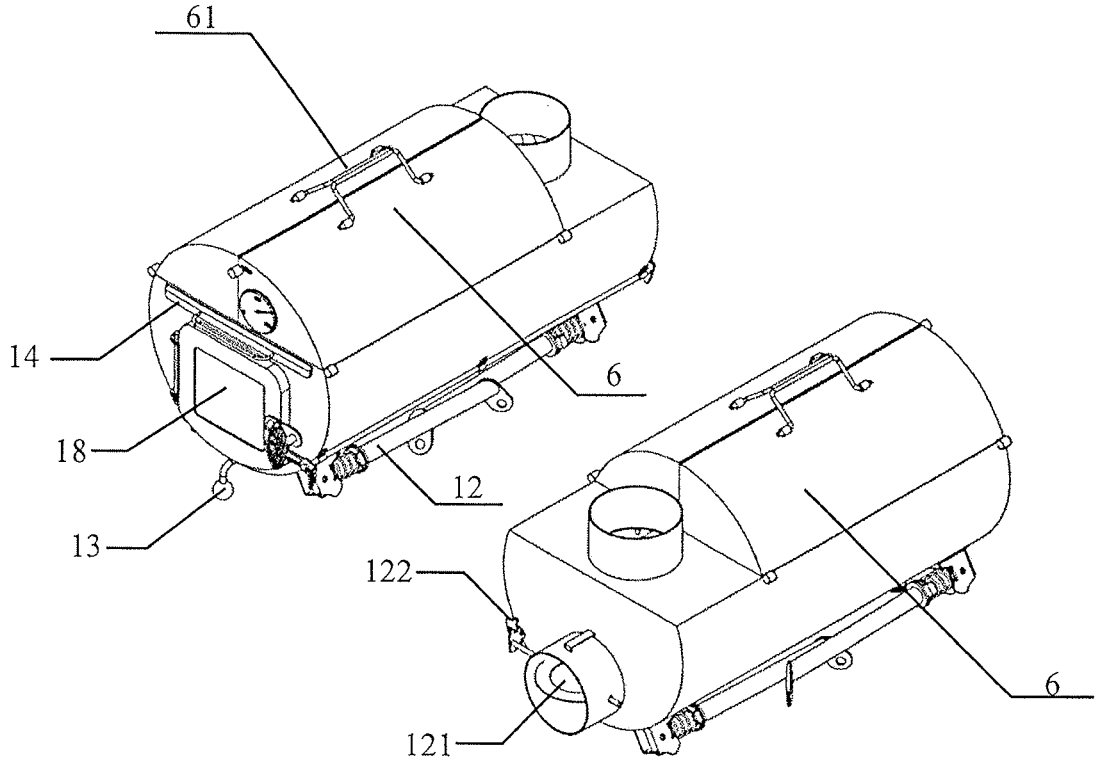
FIG. 22 shows two schematic views of a stove in a closed state respectively observed from two different perspectives according to an embodiment of the present disclosure, where the schematic view on the upper left side of the figure is a perspective view of the stove observed from an upper right side in front of the stove, and the schematic view on the lower right side of the figure is a perspective view of the stove observed from an upper right side behind the stove.

In some embodiments, as illustrated in FIG. 16, the legs 16 of the stove may each be a spring loaded leg. FIG. 22 shows two schematic views of a stove in a closed state respectively observed from two different perspectives according to an embodiment of the present disclosure. Unlike the embodiment illustrated in FIG. 7 where in the closed state of the stove the four legs 16 includes a front pair of legs that are closed up and clamp at the front bottom of the stove body 1, the four legs 16 is this embodiment includes a left pair of spring-loaded legs that are closed up and overlap at the left bottom of the stove body 1 and a right pair of spring-loaded legs that are closed up and overlap at the right bottom of the stove body 1.

Apparently, the above embodiments of the present disclosure are merely examples to illustrate the present disclosure and are not intended to limit embodiments of the present disclosure. For those of ordinary skill in the art, alterations or modifications in other different forms can be made based on the above description. Embodiments of the present disclosure cannot be and do not need to be exhausted herein. Any modifications, equivalent substitutions and improvements within the spirit and principle of the present disclosure fall within the scope of the claims of the present disclosure.

What is claimed is:

1. A stove, comprising a stove body, an air inlet channel, and an exhaust channel, wherein when the stove body is used in an enclosed space, an air inlet end of the air inlet channel is in communication with an outside of the enclosed space, a connection end of the air inlet channel is in communication with an air inlet of the stove body, the air inlet channel is operative to introduce air into the stove body from the outside of the enclosed space, wherein a connection end of the exhaust channel is in communication with an exhaust port of the stove body, an exhaust end of the exhaust channel is in communication with the outside of the enclosed space, whereby the exhaust channel is operative to discharge an exhaust gas in the stove body out of the enclosed space;

two air supplement zones are provided in the stove body and comprises a first air supplement zone and a second air supplement zone, the two air supplement zones are in communication with the connection end of the air inlet channel; wherein when the stove body is used, the first air supplement zone and the second air supplement zone are configured to allow air entering the stove body via the air inlet to successively pass through the first air supplement zone and the second air supplement zone to be discharged out of the exhaust port; and the air inlet is disposed on a rear side of the stove body, an air guide plate is arranged in the stove body to separate an interior of the stove body, into an upper part and a lower part, wherein the first air supplement zone is located on a front lower side of the air guide plate, and the second air supplement zone is located on a rear upper side of the air guide plate.

2. The stove of claim 1, wherein the stove body is provided with an air intake adjusting device configured to adjust an opening degree of the air inlet, and is further provided with a stove door arranged on a front side of the stove body, wherein openability of the stove door is associated with an opening degree of air inlet, and only when the opening degree of the air inlet is 0% or the air inlet is totally closed is the stove door openable by a user.

3. The stove of claim 2, further comprising two casings separately and rotatably connected to the stove body and symmetrically arranged on top of the stove body.

4. The stove of claim 2, wherein the air intake adjusting device comprises:

a baffle, rotatably arranged inside the connection end of the air inlet channel through a rotating shaft;

an adjusting rod, extending from a front side of the stove body to a rear side of the stove body and rotatably connected to the stove body; and a transmission assembly, wherein one end of the adjusting rod is connected to an operating bar, and another end of the adjusting rod is connected to the rotating shaft via the transmission assembly;

wherein the transmission assembly is operative to convert a rotary motion of the operating bar performed by a user into a rotary motion of the baffle, and the stove door is not confined by the operating bar only when the air inlet is completely blocked by the baffle thereby preventing external air outside of the enclosed space from entering the stove body.

5. The stove of claim 4, wherein the transmission assembly comprises:

a first gear, fixedly connected to one end of the rotating shaft; and a second gear, fixedly connected to the other end of the adjusting rod;

wherein the first gear and the second gear are engaged with each other and are operative to transfer a rotary motion of the first gear in a plane of the first gear into a rotary motion of the second gear in a plane of the second gear.

6. The stove of claim 5, wherein a plane of the first gear is perpendicular to the rotating shaft, a plane of the second gear is perpendicular to the adjusting rod, the plane of the first gear is perpendicular to the plane of the second gear, and the rotating shaft is perpendicular to the adjusting rod, wherein when a plane of the baffle is perpendicular to a longitudinal axis of the air inlet, the operating bar is perpendicular to a width of the stove door, and the stove door is not confined from being opened by the operating bar only when the operating bar is at the position perpendicular to the width of the stove door.

7. The stove of claim 6, wherein the operating bar is confined to move back and forth between a position parallel to the width of the stove door and a position perpendicular to the width of the stove door, wherein the position of the operating bar parallel to the width of the stove door corresponds to a position of the baffle parallel to the longitudinal axis of the air inlet, and the position of the operating bar perpendicular to the width of the stove door corresponds to a position of the baffle perpendicular to the longitudinal axis of the air inlet.

8. The stove of claim 1, further comprising two casings separately and rotatably connected to the stove body and symmetrically arranged on top of the stove body;

wherein the two casings when fitted together are operative to enclose a closed baking space on the top of the stove body.

9. The stove of claim 1, wherein a horizontal elongated hole is defined in a front side of the stove body, and the stove further comprises a stove cover operative to be inserted into the stove body via the elongated hole to fully seal up a fire vent defined in a top surface of the stove body and the elongated hole, wherein the stove cover is detachable from the stove body by being pulled off via the elongated hole.

10. The stove of claim 1, wherein there are provided one or more air supplement zones in the stove body, the air supplement zones being in communication with the connection end of the air inlet channel;

wherein when the stove body is used, air entering the stove body via the air inlet passes through the air supplement zones to be discharged out from the exhaust port.

11. The stove of claim 10, wherein there are provided two air supplement zones, comprising a first air supplement zone and a second air supplement zone, wherein the air entering the stove body via the air inlet successively passes through the first air supplement zone and the second air supplement zone to be discharged out of the exhaust port.

12. The stove of claim 11, wherein a stove door is arranged on a front side of the stove body, the air inlet is disposed on a rear side of the stove body, an air guide plate is arranged in the stove body to separate an interior of the stove body into an upper part and a lower part, wherein the first air supplement zone is located on a front lower side of the air guide plate, and the second air supplement zone is located on a rear upper side of the air guide plate.

13. The stove of claim 11, wherein the first air supplement zone is in communication with the connection end of the air inlet channel via a first air supplement channel;

wherein the first air channel comprises an ash box and a first air supplement pipe that are in communication with each other, wherein the ash box is disposed in a bottom of the stove body and is in communication with the first air supplement zone via an opening in the bottom of the stove body, wherein one end of the first air supplement pipe is in communication with the connection end of the air inlet channel, and another end of the first air supplement pipe is in communication with a side of the ash box, wherein there is provided an ash tray at a bottom of the ash box, and the ash tray is operative to open or close an opening in the bottom of the ash box.

14. The stove of claim 11, wherein the second air supplement zone is in communication with the connection end of the air inlet channel via a second air supplement channel;

wherein the second air supplement channel comprises a plurality of second air supplement pipes, wherein an end of each of the plurality of second air supplement pipes is in communication with the connection end of the air inlet channel, and another end of the second air supplement pipe extends into the stove, wherein at least one air venting hole is opened in a sidewall of the portion of each of the plurality of second air supplement pipes that extends into the stove body.

15. The stove of claim 11, wherein the stove body is provided with an air intake adjusting device operative to adjust an opening degree of the air inlet.

16. The stove of claim 15, wherein the air intake adjusting device comprises:

a baffle, rotatably arranged inside the connection end of the air inlet channel through a rotating shaft; and an adjusting rod, extending from a front side of the stove body to a rear side of the stove body and slidably connected to the stove body, wherein an end of the adjusting rod is connected to an operating handle and another end of the adjusting rod is connected to the rotating shaft via a transmission assembly, wherein the adjusting rod when sliding is operative to drive the baffle to rotate to adjust the opening degree of the air inlet.

17. The stove of claim 11, wherein the first air supplement zone is in communication with the connection end of the air inlet channel via a first air supplement channel;

wherein an air adjusting device is arranged in the stove body and is operative to adjust an opening degree of a communicating port between the first air supplement channel and the stove body.

* * * * *